US010989079B2

(12) United States Patent
Chikayama et al.

(10) Patent No.: US 10,989,079 B2
(45) Date of Patent: Apr. 27, 2021

(54) CONTROL DEVICE AND CONTROL METHOD FOR VALVE TIMING ADJUSTMENT DEVICE

(71) Applicant: Mitsubishi Electric Corporation, Tokyo (JP)

(72) Inventors: Takuya Chikayama, Tokyo (JP); Masayuki Yokoyama, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/761,134

(22) PCT Filed: Feb. 27, 2018

(86) PCT No.: PCT/JP2018/007310
§ 371 (c)(1),
(2) Date: May 1, 2020

(87) PCT Pub. No.: WO2019/167135
PCT Pub. Date: Sep. 6, 2019

(65) Prior Publication Data
US 2020/0271021 A1 Aug. 27, 2020

(51) Int. Cl.
*F01L 1/34* (2006.01)
*F01L 1/344* (2006.01)

(52) U.S. Cl.
CPC ... *F01L 1/3442* (2013.01); *F01L 2001/34463* (2013.01); *F01L 2001/34466* (2013.01)

(58) Field of Classification Search
CPC ..... F01L 1/3442; F01L 2001/34463; F01L 2001/34466; F01L 2001/34456; F01L 2001/34469; F01L 2001/34453
See application file for complete search history.

(56) References Cited

U.S. PATENT DOCUMENTS

2013/0199478 A1* 8/2013 Tanaka ..... F01L 1/3442
123/90.17

FOREIGN PATENT DOCUMENTS

| | | | |
|---|---|---|---|
| JP | 5288043 | B2 | 9/2013 |
| JP | 5288044 | B2 | 9/2013 |
| WO | WO 2012/086084 | A1 | 6/2012 |
| WO | WO 2012/086085 | A1 | 6/2012 |
| WO | WO 2015/033676 | A1 | 3/2015 |

* cited by examiner

*Primary Examiner* — Zelalem Eshete
(74) *Attorney, Agent, or Firm* — Birch, Stewart, Kolasch & Birch, LLP.

(57) ABSTRACT

An ECU (101) causes lock pin-release hydraulic pressure to be applied to an advance-side lock pin-release oil passage (5*a*) to disengage an advance-side lock pin (6) from an advance-side engagement groove (9), thereby making a rotor (1) rotatable in an advance direction, and forming a clearance communicating with a retard-side lock pin-release oil passage (5*c*), between the advance-side engagement groove (9) and the advance-side lock pin (6). Next, the ECU (101) causes hydraulic pressure to be applied to advancing hydraulic chambers (16) to rotate the rotor (1), and causes the lock pin-release hydraulic pressure to be applied through the clearance and through the retard-side lock pin-release oil passage (5*c*) to a retard-side engagement groove (10) to disengage a retard-side lock pin (7).

4 Claims, 17 Drawing Sheets

CONTROL DEVICE AND CONTROL METHOD FOR VALVE TIMING ADJUSTMENT DEVICE

TECHNICAL FIELD

This invention relates to a control device and a control method for a valve timing adjustment device in which a lock pin engages in an intermediate position between the most advanced position and the most retarded position.

BACKGROUND ART

A valve timing adjustment device for controlling opening and closing timings of an intake or exhaust valve has conventionally been devised. Such valve timing adjustment device includes a first rotary body, a second rotary body that is relatively rotatable with respect to the first rotary body at a predetermined angle, and a lock mechanism for locking the second rotary body in an intermediate position upon engine start-up.

For example, a process needs to be followed as follows. A control device for a valve timing adjustment device according to Patent Literature 1 applies hydraulic pressure to an advancing hydraulic chamber to apply rotational force to the second rotary body in the advance direction, thereby keeping an advance-side lock pin pressed against the circumferential surface of an advance-side engagement hole. In such condition, the control device applies lock pin-release hydraulic pressure to the advance-side engagement hole and to a retard-side engagement hole, and thereby first allows a retard-side lock pin to disengage from a retard-side engagement groove. Then, the control device causes hydraulic pressure to be applied to a retarding hydraulic chamber to apply rotational force to the second rotary body in the retard direction, and thereby allows the advance-side lock pin to be released and disengaged from the circumferential surface of the advance-side engagement hole.

CITATION LIST

Patent Literatures

Patent Literature 1: WO 2015/033676 A

SUMMARY OF INVENTION

Technical Problem

The control device for a valve timing adjustment device according to Patent Literature 1 needs to sequentially apply advancing hydraulic pressure, lock pin-release hydraulic pressure, and retarding hydraulic pressure to unlock the intermediate lock. Thus, it takes a long time to unlock the intermediate lock and to allow the valve timing adjustment device to operate, which presents a problem of low responsivity.

This invention has been made to solve the foregoing problem, and it is an object of the present invention to reduce the time required to unlock the intermediate lock and to allow the valve timing adjustment device to operate, and thereby to enhance responsivity.

Solution to Problem

A control device for a valve timing adjustment device according to this invention is a control device for a valve timing adjustment device that includes a first rotary body including a hydraulic chamber, a second rotary body including a vane which separates the hydraulic chamber into an advance-side section and a retard-side section, the second rotary body being relatively rotatable with respect to the first rotary body, the second rotary body being accommodated in the first rotary body, and a lock mechanism for locking the second rotary body in an intermediate position between a most advanced position and a most retarded position, the lock mechanism including a through hole formed inside the vane in an axial direction of the second rotary body, a cylindrical member having a cylindrical shape introduced into the through hole in a state in which axial sliding and rotational movement relative to the through hole are restricted, a first lock pin and a second lock pin provided coaxially with each other inside the cylindrical member, a first engagement groove and a second engagement groove which are formed in the first rotary body, and with which the first lock pin and the second lock pin are to be respectively engaged, a biasing member that biases the first lock pin toward the first engagement groove, and that biases the second lock pin toward the second engagement groove, a first lock pin-release oil passage that is formed in an outer circumferential surface of the cylindrical member or in an inner circumferential surface of the through hole, and that is to apply lock pin-release hydraulic pressure to the first engagement groove, and a second lock pin-release oil passage that is formed in the outer circumferential surface of the cylindrical member or in the inner circumferential surface of the through hole, and that is to apply, to the second engagement groove, the lock pin-release hydraulic pressure applied to the first engagement groove, in which the control device includes: a processor to execute a program; and a memory to store the program which, when executed by the processor, performs processes of, in a state in which the first lock pin is engaged with the first engagement groove and the second lock pin is engaged with the second engagement groove to lock the second rotary body in the intermediate position, causing the lock pin-release hydraulic pressure to be applied to the first lock pin-release oil passage to disengage the first lock pin from the first engagement groove, thereby making the second rotary body rotatable in an advance direction or in a retard direction, and forming a clearance communicating with the second lock pin-release oil passage, between the first engagement groove and the first lock pin; and causing hydraulic pressure to be applied to the section of the hydraulic chamber corresponding to the direction in which the second rotary body is made rotatable to rotate the second rotary body, and causing the lock pin-release hydraulic pressure in the first engagement groove to be applied through the clearance and through the second lock pin-release oil passage to the second engagement groove to disengage the second lock pin, so that the second rotary body is unlocked.

Advantageous Effects of Invention

According to this invention, lock pin-release hydraulic pressure and either advancing or retarding hydraulic pressure are applied to unlock the intermediate lock, which can reduce the time required to unlock the intermediate lock and to allow the valve timing adjustment device to operate, and can thus enhance responsivity as compared to conventional ones.

BRIEF DESCRIPTION OF DRAWINGS

FIG. 4 is a set of views illustrating an example configuration of a press-fit member of the first embodiment.

FIG. 14 is a set of views illustrating a state in which the valve timing adjustment device is locked in an intermediate position.

FIG. 15 is a set of views illustrating a state in which an advance-side lock pin is disengaged and a retard-side lock pin-release oil passage is opened.

FIG. 16 is a set of views illustrating a state in which not only the advance-side lock pin but also a retard-side lock pin is disengaged.

FIG. 17 is a set of views illustrating a state in which a rotor receives retarding hydraulic pressure and thus moves in the retard direction.

DESCRIPTION OF EMBODIMENTS

To describe this invention in more detail, modes for carrying out this invention will be described below with reference to the accompanying drawings.

First Embodiment

Figure 1:
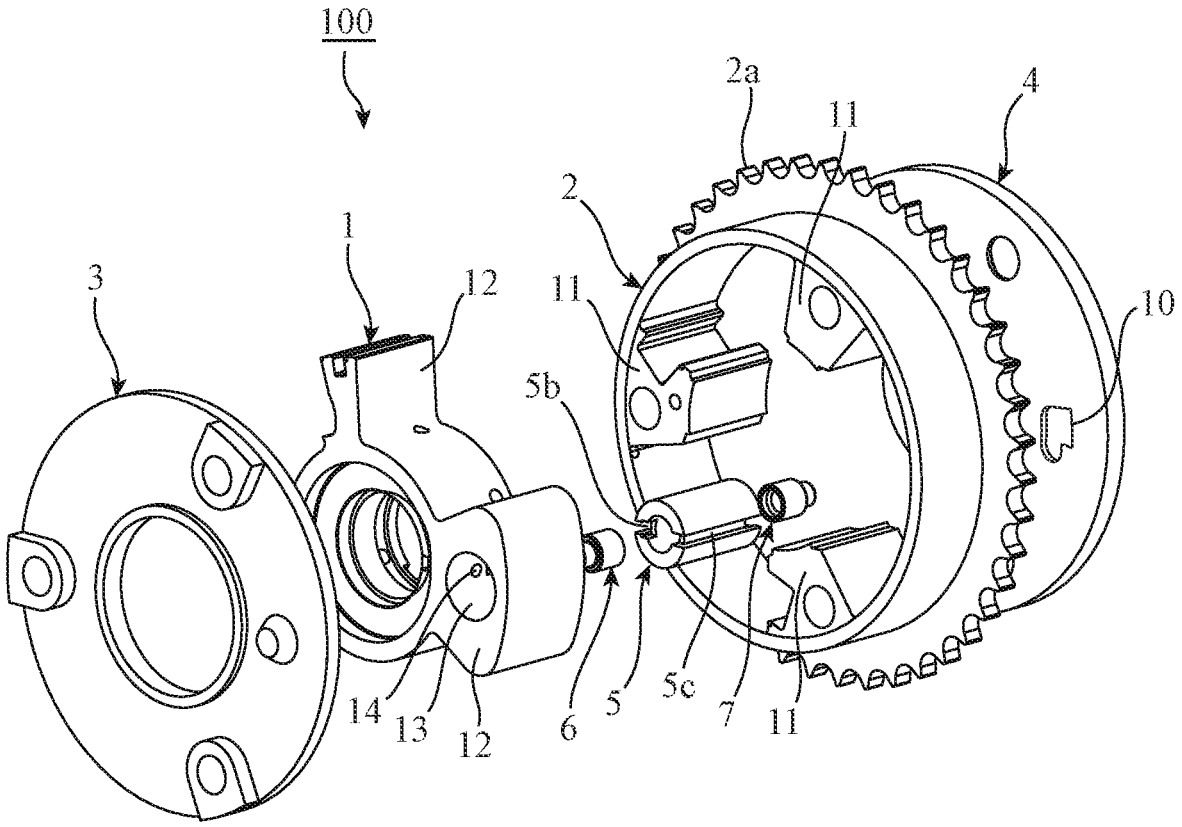
FIG. 1 is an exploded perspective view illustrating an example configuration of a valve timing adjustment device according to a first embodiment.
Figure 2:
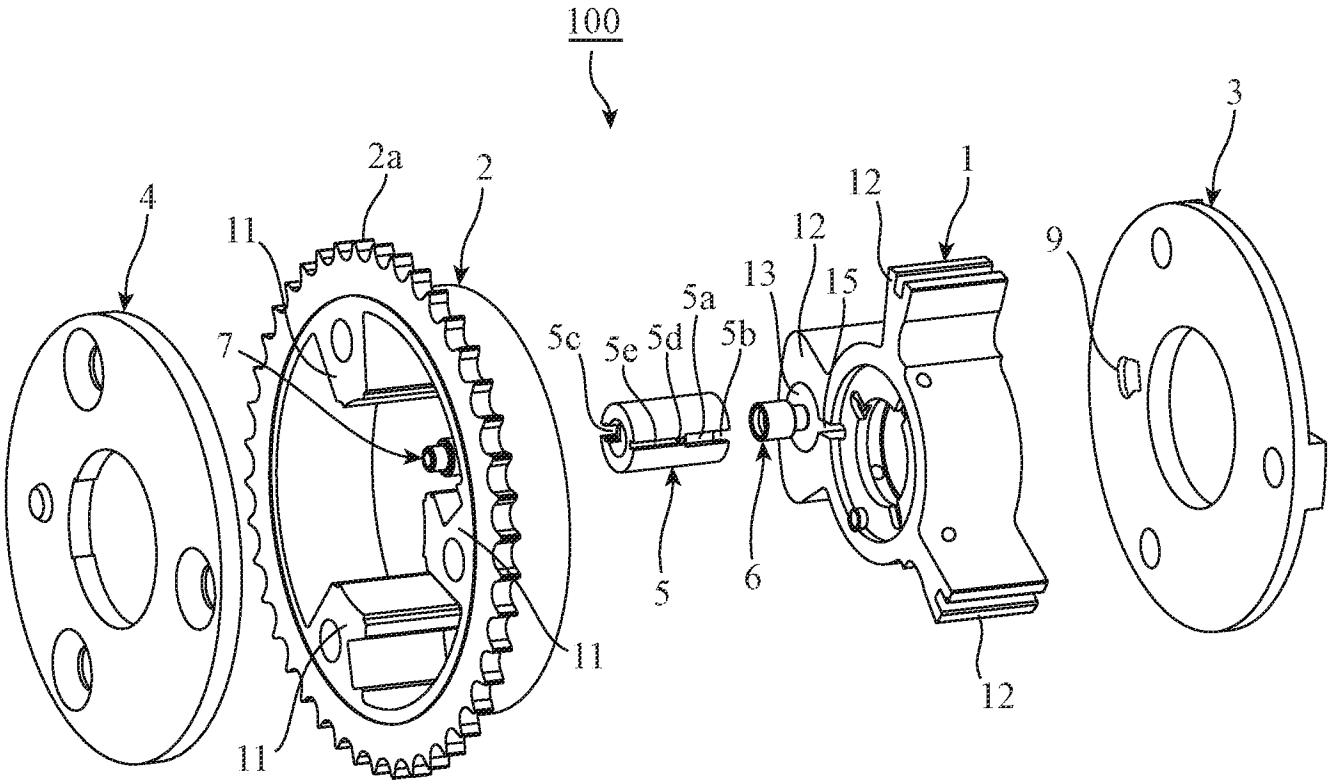
FIG. 2 is an exploded perspective view illustrating the example configuration of the valve timing adjustment device according to the first embodiment.
Figure 3:
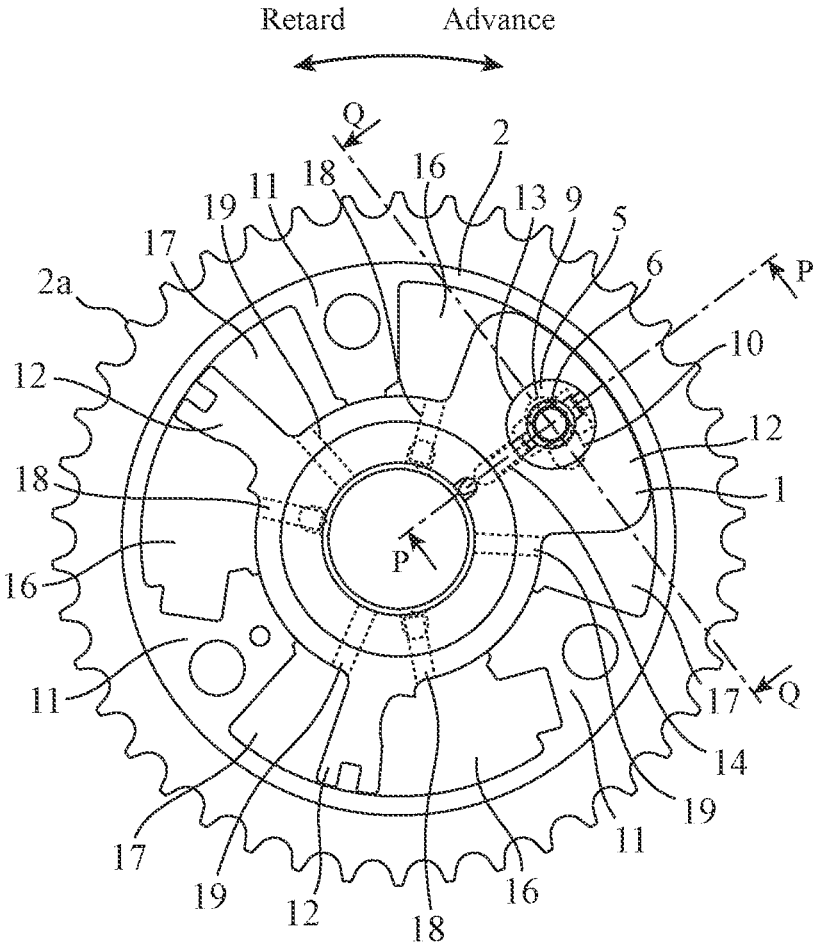
FIG. 3 is a front view illustrating the example configuration of the valve timing adjustment device according to the first embodiment.

FIG. 1 is an exploded perspective view illustrating an example configuration of a valve timing adjustment device 100 according to a first embodiment, viewed from the front. FIG. 2 is an exploded perspective view illustrating the example configuration of the valve timing adjustment device 100 according to the first embodiment, viewed from the rear. Note that FIGS. 1 and 2 do not illustrate a coil spring 8. FIG. 3 is a front view illustrating the example configuration of the valve timing adjustment device 100 according to the first embodiment, having a casing 2 being locked in an intermediate position, i.e., being in a locked state. Note that FIG. 3 does not illustrate a plate 3.

The casing 2 includes multiple shoes 11 projecting radially inwardly and forming multiple hydraulic chambers. A rotor 1 includes multiple vanes 12 that each separate the corresponding one of the hydraulic chambers of the casing 2 into an advancing hydraulic chamber 16 and a retarding hydraulic chamber 17. When the rotor 1 is accommodated in the casing 2, the plate 3, the casing 2, and a cover 4 are integrated together by means of screws or the like. The integration causes both sides of the casing 2 to be covered with the plate 3 and the cover 4, and the hydraulic chambers are thus sealed. These elements, i.e., the casing 2, the plate 3, and the cover 4 are included in a first rotary body. The rotor 1 is included in a second rotary body. The second rotary body is relatively rotatable with respect to the first rotary body.

The casing 2 has sprockets 2*a* formed on the outer circumference thereof. A timing belt (not shown) placed on these sprockets 2*a* transmits driving force of the crankshaft of the engine to the casing 2, thereby causing the first rotary body including the casing 2, the plate 3, and the cover 4 to rotate in synchronism with the crankshaft. Meanwhile, the rotor 1 is fixed to a camshaft 20 illustrated in FIG. 5 mentioned later, and rotates in synchronism with the camshaft.

The rotor 1 includes multiple advancing oil passages 18, multiple retarding oil passages 19, and one rotor-side lock pin-release oil passage 14 each formed therein. The advancing oil passages 18 communicate with the respective advancing hydraulic chambers 16, while the retarding oil passages 19 communicate with the respective retarding hydraulic chambers 17. The rotor-side lock pin-release oil passage 14 communicates with an advance-side lock pin-release oil passage 5*a* described later.

Hydraulic pressure applied and removed through an oil control valve 102 (hereinafter referred to as "OCV 102") illustrated in FIG. 13 mentioned later is applied to, and removed from, the advancing hydraulic chambers 16 and the retarding hydraulic chambers 17 respectively through the advancing oil passages 18 and through the retarding oil passages 19. Application of hydraulic pressure to the advancing hydraulic chambers 16 causes the relative phase of the second rotary body with respect to the first rotary body to be adjusted in the advance direction, which causes the relative phase of the camshaft with respect to the crankshaft to be changed in the advance direction, and thereby opening and closing timings of the intake valve or the exhaust valve of the engine also to be changed. On the other hand, application of hydraulic pressure to the retarding hydraulic chambers 17 causes the relative phase of the second rotary body with respect to the first rotary body to be adjusted in the retard direction, which causes the relative phase of the camshaft with respect to the crankshaft to be changed in the retard direction, and thereby opening and closing timings of the intake valve or the exhaust valve of the engine also to be changed. FIG. 3 illustrates the direction in which the rotor 1 rotates clockwise with respect to the casing 2 as the advance direction, and the direction in which the rotor 1 rotates counterclockwise with respect to the casing 2 as the retard direction.

In addition, one of the vanes 12 of the rotor 1 includes a lock mechanism for locking the rotor 1 in an intermediate position between the most advanced position and the most retarded position. Note that the intermediate position needs only to be a position between the most advanced position and the most retarded position, and does not need to be a midpoint in a strict sense. The lock mechanism will be described below in detail with reference to FIGS. 4 to 7.

Figure 4A:
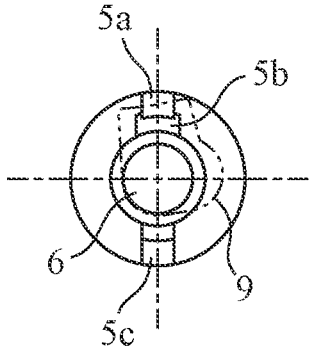
FIG. 4A illustrates the end face on the plate side.
Figure 4B:
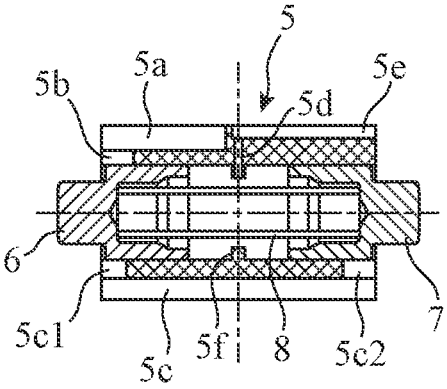
FIG. 4B illustrates a cross section.
Figure 4C:
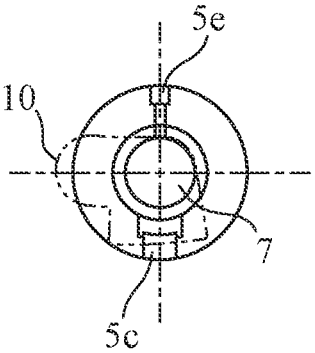
FIG. 4C illustrates the end face on the cover side.
Figure 5:
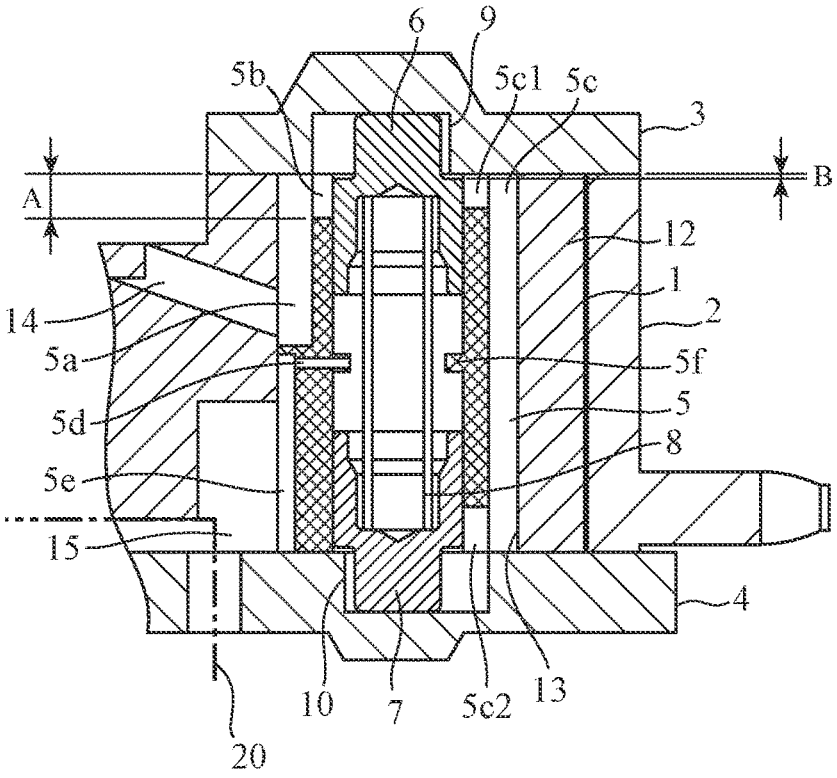
FIG. 5 is a cross-sectional view of the lock mechanism of the first embodiment taken along line P-P of FIG. 3, illustrating a locked state.
Figure 6:
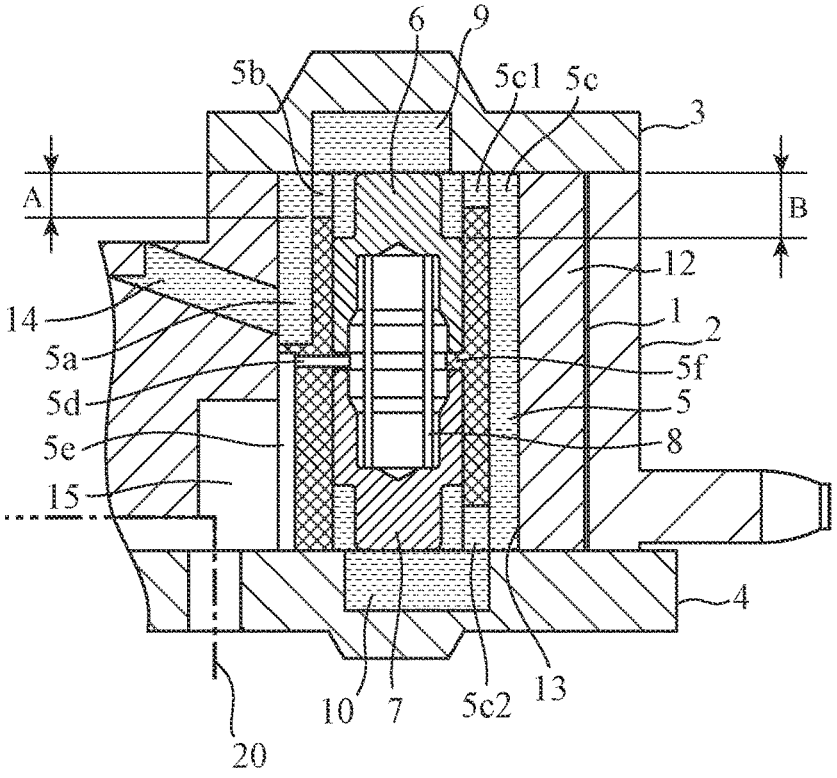
FIG. 6 is a cross-sectional view of the lock mechanism of the first embodiment taken along line P-P of FIG. 3, illustrating an unlocked state.
Figure 7:
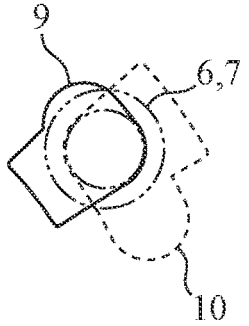
FIG. 7 is a front view illustrating an example of formation of an advance-side engagement groove and of a retard-side engagement groove of the first embodiment.

FIG. 4 is a set of views illustrating an example configuration of a press-fit member 5; FIG. 4A illustrates the end face on the plate 3 side, FIG. 4B illustrates a cross section, and FIG. 4C illustrates the end face on the cover 4 side. FIG. 5 is a cross-sectional view of the lock mechanism of the first embodiment taken along line P-P of FIG. 3, illustrating a locked state. FIG. 6 is a cross-sectional view of the lock mechanism of the first embodiment taken along line P-P of FIG. 3, illustrating an unlocked state. FIG. 7 is a front view illustrating an example of formation of an advance-side engagement groove 9 and of a retard-side engagement groove 10 of the first embodiment. FIG. 7 illustrates the shape of the advance-side engagement groove 9 using a solid line, the shape of the retard-side engagement groove 10 using a broken line, and the shapes of an advance-side lock pin 6 and of a retard-side lock pin 7 using a dashed-double-dotted line.

One of the vanes 12 has a through hole 13 formed therein to penetrate the vane 12 in the axial direction of the casing 2. The press-fit member 5, having a cylindrical shape, is press-fit into the through hole 13. Being press fit into the through hole 13, the press-fit member 5 is introduced into the through hole 13 in a state in which axial sliding and rotational movement relative to the through hole 13 are restricted. Note that, as described later, the press-fit member 5 needs only to communicate with the rotor-side lock pin-release oil passage 14 of the rotor 1 to form a lock pin-release oil passage, and accordingly, there is no need to be introduced into the through hole 13 by press fitting. For example, a configuration in which a cylindrical member is inserted in the through hole 13 will allow this cylindrical member to function equivalently to the press-fit member 5 if this cylindrical member will not undergo axial sliding or rotational movement.

The advance-side lock pin 6 and the retard-side lock pin 7 are provided coaxially with each other inside the press-fit member 5. In the plate 3, an arc-shaped groove is formed which has the radius of curvature corresponding to the rotational direction of the casing 2, at a position facing the advance-side lock pin 6, and another groove is formed which projects from this arc-shaped groove in a direction to face a cutout portion 5*b* of the press-fit member 5 described later. These grooves together form the advance-side engagement groove 9. Moreover, in the cover 4, an arc-shaped groove is formed which has the radius of curvature corresponding to the rotational direction of the casing 2, at a position facing the retard-side lock pin 7, and another groove is formed which projects from this arc-shaped groove in a direction to face a cutout portion 5*c*2 of the press-fit member 5 described later. These grooves together form the retard-side engagement groove 10.

One coil spring 8, which is a biasing member, is provided between the advance-side lock pin 6 and the retard-side lock pin 7. This coil spring 8 biases the advance-side lock pin 6 toward the advance-side engagement groove 9 to engage the advance-side lock pin 6 with the advance-side engagement groove 9, and at the same time, biases the retard-side lock pin 7 toward the retard-side engagement groove 10 to engage the retard-side lock pin 7 with the retard-side engagement groove 10.

The outer circumferential surface of the press-fit member 5 has a groove formed therein that extends from the rotor-side lock pin-release oil passage 14 to the advance-side engagement groove 9, and this groove is the advance-side lock pin-release oil passage 5*a*. This groove is covered and sealed by the inner circumferential surface of the through hole 13 and by the inner surface of the plate 3. In addition, the press-fit member 5 has a portion facing the advance-side engagement groove 9 in the advance-side lock pin-release oil passage 5*a* being cut out to form the cutout portion 5*b*. Formation of the cutout portion 5*b* permits the advance-side lock pin-release oil passage 5*a* and the advance-side engagement groove 9 to communicate with each other. Lock pin-release hydraulic pressure applied to the rotor-side lock pin-release oil passage 14 is applied from the rotor-side lock pin-release oil passage 14 through the advance-side lock pin-release oil passage 5*a* and through the cutout portion 5*b* to the advance-side engagement groove 9. The lock pin-release hydraulic pressure applied to the advance-side engagement groove 9 causes the advance-side lock pin 6 to withdraw from the advance-side engagement groove 9 against biasing force of the coil spring 8, thereby releasing the engagement between the advance-side lock pin 6 and the advance-side engagement groove 9. During the engagement, oil accumulated in the advance-side engagement groove 9 is drained through the advance-side lock pin-release oil passage 5*a* to the rotor-side lock pin-release oil passage 14.

The outer circumferential surface of the press-fit member 5 also has a groove formed therein that extends from the advance-side engagement groove 9 to the retard-side engagement groove 10, and cutout portions 5*c*1 and 5*c*2 formed therein by cutting out at both end portions of the groove. The groove and the cutout portions 5*c*1 and 5*c*2 together form a retard-side lock pin-release oil passage 5*c*. The groove and the cutout portions 5*c*1 and 5*c*2 are covered and sealed by the inner circumferential surface of the through hole 13, by the inner surface of the plate 3, and by the inner surface of the cover 4. However, when the advance-side lock pin 6 is withdrawn from the advance-side engagement groove 9 causing the engagement to be released, a clearance is formed between the advance-side lock pin 6 and the advance-side engagement groove 9, and this clearance communicates with the cutout portion 5*c*1 on the advance-side engagement groove 9 side, of the retard-side lock pin-release oil passage 5*c*. In addition, the cutout portion 5*c*2 is formed at a position facing the retard-side engagement groove 10. Lock pin-release hydraulic pressure applied to the advance-side engagement groove 9 is applied from the foregoing clearance formed between the advance-side lock pin 6 and the advance-side engagement groove 9 through the retard-side lock pin-release oil passage 5*c* to the retard-side engagement groove 10. The lock pin-release hydraulic pressure applied to the retard-side engagement groove 10 causes the retard-side lock pin 7 to withdraw from the retard-side engagement groove 10 against biasing force of the coil spring 8, thereby releasing the engagement between the retard-side lock pin 7 and the retard-side engagement groove 10. During the engagement, oil accumulated in the retard-side engagement groove 10 is drained through the retard-side lock pin-release oil passage 5*c*, through the advance-side engagement groove 9, and through the advance-side lock pin-release oil passage 5*a* to the rotor-side lock pin-release oil passage 14.

Note that the groove of the advance-side lock pin-release oil passage 5*a* and the groove of the retard-side lock pin-release oil passage 5*c* may each have a linear shape or any shape such as a helical shape.

In addition, although the illustrated example is illustrated so that the advance-side lock pin-release oil passage 5*a* and the retard-side lock pin-release oil passage 5*c* are provided at equal intervals, both the oil passages may have any positional relationship.

As illustrated in FIG. 5, when biasing force of the coil spring 8 acts on the advance-side lock pin 6 to engage with the advance-side engagement groove 9, and acts on the retard-side lock pin 7 to engage with the retard-side engagement groove 10, the rotor 1 is locked in an intermediate position. In contrast, as illustrated in FIG. 6, when lock pin-release hydraulic pressure applied from the rotor-side lock pin-release oil passage 14 acts on the advance-side lock pin 6 to disengage from the advance-side engagement groove 9, and acts on the retard-side lock pin 7 to disengage from the retard-side engagement groove 10, the rotor 1 becomes relatively rotatable. Note that abutment, on a stopper 5*f* of the press-fit member 5, of the advance-side lock pin 6 and of the retard-side lock pin 7 withdrawn respectively from the advance-side engagement groove 9 and from the retard-side engagement groove 10 prevents the advance-side lock pin 6 and the retard-side lock pin 7 from being withdrawn further.

The advance-side lock pin 6 does not receive cam torque in the retard direction, and thus easily comes out of the advance-side engagement groove 9. In contrast, the retard-side lock pin 7 receives cam torque and is thus pressed on a retard-side side wall of the retard-side engagement groove 10, and is accordingly not easy to come out of the retard-side engagement groove 10. Thus, the lock mechanism of the first embodiment is structured to first release the engagement of the advance-side lock pin 6 not receiving cam torque, and then release the engagement of the retard-side lock pin 7. This structure enables the advance-side lock pin 6 to be reliably disengaged before the retard-side lock pin 7.

In addition, to reliably disengage the advance-side lock pin 6 before the retard-side lock pin 7, the structure described below is desirable.

Let "A" denote the length of the cutout portion 5*b* in the axial direction of the casing 2. In addition, let "B" denote the length of the clearance between the advance-side lock pin 6 and the advance-side engagement groove 9 in the axial direction of the casing 2. The clearance having the length "B" is a clearance to be formed when the advance-side lock pin 6 is disengaged from the advance-side engagement groove 9, and serves as an oil passage for applying the lock pin-release hydraulic pressure from the advance-side engagement groove 9 to the retard-side lock pin-release oil passage 5*c*. The magnitude relationship between A and B is A>B in the locked state illustrated in FIG. 5, and A≤B in the unlocked state illustrated in FIG. 6. This magnitude relationship ensures that the retard-side lock pin-release oil passage 5*c* will not be established unless the advance-side lock pin 6 is disengaged in the locked state of FIG. 5, thereby enabling the advance-side lock pin 6 to be reliably disengaged.

A fluid drain channel 5*d*, which is a through hole communicating between the inside and the outside of the press-fit member 5, is formed at the position of the stopper 5*f* of the press-fit member 5. In addition, a fluid drain channel 5*e*, which is a groove communicating between the fluid drain channel 5*d* and a rotor-side fluid drain channel 15, is formed in the outer circumferential surface of the press-fit member 5. Clearances are inevitably formed between the press-fit member 5 and the advance-side lock pin 6 and between the press-fit member 5 and the retard-side lock pin 7 to permit the advance-side lock pin 6 and the retard-side lock pin 7 to slide. Oil and air flow into the press-fit member 5 through these clearances. The oil and air are drained through the fluid drain channel 5*d* and through the fluid drain channel 5*e*, out of the rotor-side fluid drain channel 15.

As described above, the through hole 13 included in the lock mechanism of the first embodiment is formed inside one of the vanes 12 in the axial direction of the rotor 1, which is included in the second rotary body. The press-fit member 5 is a cylindrical member, and is introduced into the through hole 13 in a state in which axial sliding and rotational movement relative to the through hole 13 are restricted. The advance-side lock pin 6 and the retard-side lock pin 7 are provided coaxially with each other inside the press-fit member 5. The advance-side engagement groove 9 and the retard-side engagement groove 10 are respectively formed in the plate 3 and in the cover 4 included in the first rotary body to respectively allow the advance-side lock pin 6 and the retard-side lock pin 7 to engage therewith. The coil spring 8 biases the advance-side lock pin 6 toward the advance-side engagement groove 9, and biases the retard-side lock pin 7 toward the retard-side engagement groove 10. The advance-side lock pin-release oil passage 5*a* is formed in the outer circumferential surface of the press-fit member 5 to apply the lock pin-release hydraulic pressure to the advance-side engagement groove 9. The retard-side lock pin-release oil passage 5*c* is formed in the outer circumferential surface of the press-fit member 5 to apply the lock pin-release hydraulic pressure applied to the advance-side engagement groove 9, to the retard-side engagement groove 10. As such, the simply-shaped longitudinal grooves formed in the outer circumferential surface of the press-fit member 5 respectively serve as the advance-side lock pin-release oil passage 5*a* and the retard-side lock pin-release oil passage 5*c*. This eliminates the need for producing a lock pin-release oil passage having a complex shape inside the vane 12, and it is thus sufficient to form the through hole 13 having a simple shape in the vane 12.

In addition, the press-fit member 5 of the first embodiment has the cutout portion 5*b*, formed by cutting out a portion facing the advance-side engagement groove 9 in the advance-side lock pin-release oil passage 5*a*. In this configuration, when the advance-side lock pin 6 is engaged with the advance-side engagement groove 9, the length B of the clearance between the advance-side lock pin 6 and the advance-side engagement groove 9, the clearance communicating with the retard-side lock pin-release oil passage 5*c*, is less than the length A of the cutout portion 5*b* in the axial direction of the casing 2. Meanwhile, when the advance-side lock pin 6 is disengaged from the advance-side engagement groove 9, the length B of the clearance between the advance-side lock pin 6 and the advance-side engagement groove 9, the clearance communicating with the retard-side lock pin-release oil passage 5*c*, is greater than or equal to the length A of the cutout portion 5*b* in the axial direction of the casing 2. This enables the advance-side lock pin 6 to be reliably disengaged before the retard-side lock pin 7.

Moreover, the press-fit member 5 of the first embodiment has the fluid drain channels 5*d* and 5*e* for draining fluid between the advance-side lock pin 6 and the retard-side lock pin 7 to the outside. Meanwhile, this only requires, in the corresponding one of the vanes 12, production of a longitudinal hole communicating with the fluid drain channels 5*d* and 5*e*, i.e., the rotor-side fluid drain channel 15. A method is often used conventionally in which a transverse hole is produced in the rotor 1 to be used as the rotor-side fluid drain channel, but in the first embodiment, a longitudinal hole is produced in the rotor 1, and the longitudinal hole can be used as the rotor-side fluid drain channel 15. This enables a fluid drain channel to be implemented by an easier production operation than conventional ones.

Note that the fluid drain channel 5*e* may be not provided, and the fluid drain channel 5*d* may be structured to communicate directly with the rotor-side fluid drain channel 15.

Furthermore, the coil spring 8 of the first embodiment may have a linear spring constant or may have a nonlinear spring constant. A coil spring 8 having a nonlinear spring constant is an irregular pitch spring whose biasing force varies during expansion and contraction, or other similar spring. For example, a coil spring 8 having a nonlinear spring constant is used in such a manner that force to bias the retard-side lock pin 7 toward the retard-side engagement groove 10 is greater than force to bias the advance-side lock pin 6 toward the advance-side engagement groove 9. This can prevent a situation in which, during an unlocking operation, the retard-side lock pin 7 is disengaged from the retard-side engagement groove 10 before the advance-side lock pin 6 is disengaged from the advance-side engagement groove 9 even if the lock pin-release hydraulic pressure leaks through the clearance to the retard-side engagement groove 10.

Second Embodiment

Figure 8:
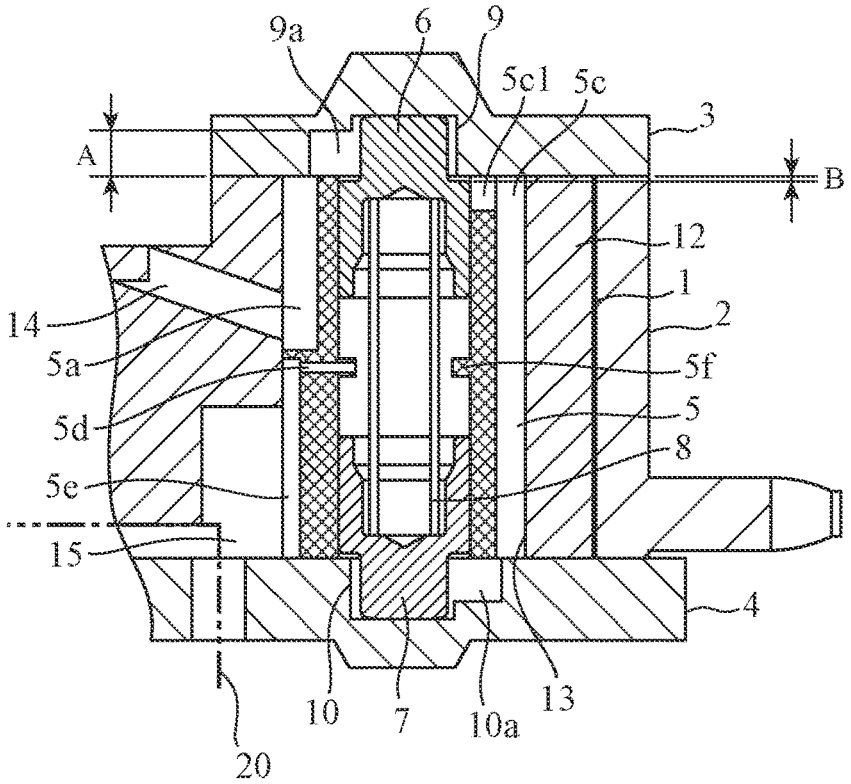
FIG. 8 is a cross-sectional view of a lock mechanism of a second embodiment taken along line P-P of FIG. 3, illustrating a locked state.
Figure 9:
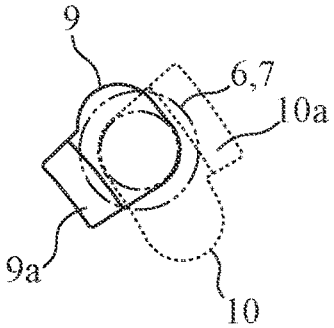
FIG. 9 is a front view illustrating an example of formation of an advance-side engagement groove and of a retard-side engagement groove of the second embodiment.

A valve timing adjustment device 100 according to a second embodiment is structured the same as the valve timing adjustment device 100 according to the first embodiment except for the lock mechanism, and FIGS. 1 to 7 thus also apply to the following description. FIG. 8 is a cross-sectional view of a lock mechanism of the second embodiment taken along line P-P of FIG. 3, illustrating a locked state. FIG. 9 is a front view illustrating an example of formation of an advance-side engagement groove 9 and of a retard-side engagement groove 10 of the second embodiment. FIG. 9 illustrates the shape of the advance-side engagement groove 9 using a solid line, the shape of the retard-side engagement groove 10 using a broken line, and the shapes of the advance-side lock pin 6 and of the retard-side lock pin 7 using a dashed-double-dotted line. In FIGS. 8 and 9, elements identical or equivalent to the corresponding elements of FIGS. 1 to 7 are indicated by the same reference characters, and a description thereof will be omitted.

In the first embodiment, the press-fit member 5 is structured to have the cutout portion 5*b*, but in the second embodiment, a recessed portion 9*a* is formed in place of this cutout portion 5*b*. Specifically, the advance-side engagement groove 9 has a recessed portion 9*a*, which is a recess formed in a portion facing the advance-side lock pin-release oil passage 5*a*. Formation of the recessed portion 9*a* permits the advance-side lock pin-release oil passage 5*a* and the advance-side engagement groove 9 to communicate with each other. The lock pin-release hydraulic pressure applied to the rotor-side lock pin-release oil passage 14 is applied from the rotor-side lock pin-release oil passage 14 through the advance-side lock pin-release oil passage 5*a* and through the recessed portion 9*a* to the advance-side engagement groove 9.

Note that similarly to the configuration on the advance side, a recessed portion 10*a* may be formed in the retard-side engagement groove 10 in place of the cutout portion 5*c*2 on the retard side. The lock pin-release hydraulic pressure applied to the advance-side engagement groove 9 is applied from the advance-side engagement groove 9 through the cutout portion 5*c*1, through the retard-side lock pin-release oil passage 5*c*, and through the recessed portion 10*a* to the retard-side engagement groove 10.

Let "A" denote the length of the recessed portion 9*a* in the axial direction of the casing 2. In addition, similarly to the first embodiment, let "B" denote the length of the clearance between the advance-side lock pin 6 and the advance-side engagement groove 9 in the axial direction of the casing 2. The magnitude relationship between A and B is A>B in the locked state illustrated in FIG. 8, and A≤B in the unlocked state (not shown). This magnitude relationship ensures that the retard-side lock pin-release oil passage 5*c* will not be established unless the advance-side lock pin 6 is disengaged in the locked state of FIG. 8, thereby enabling the advance-side lock pin 6 to be reliably disengaged.

As described above, the advance-side engagement groove 9 of the second embodiment has the recessed portion 9*a*, which is a recess formed in a portion facing the advance-side lock pin-release oil passage 5*a*. In this configuration, when the advance-side lock pin 6 is engaged with the advance-side engagement groove 9, the length B of the clearance between the advance-side lock pin 6 and the advance-side engagement groove 9, the clearance communicating with the retard-side lock pin-release oil passage 5*c*, is less than the length A of the recessed portion 9*a* in the axial direction of the casing 2. Meanwhile, when the advance-side lock pin 6 is disengaged from the advance-side engagement groove 9, the length B of the clearance between the advance-side lock pin 6 and the advance-side engagement groove 9, the clearance communicating with the retard-side lock pin-release oil passage 5*c*, is greater than or equal to the length A of the recessed portion 9*a* in the axial direction of the casing 2. This enables the advance-side lock pin 6 to be reliably disengaged before the retard-side lock pin 7.

Third Embodiment

Figure 10:
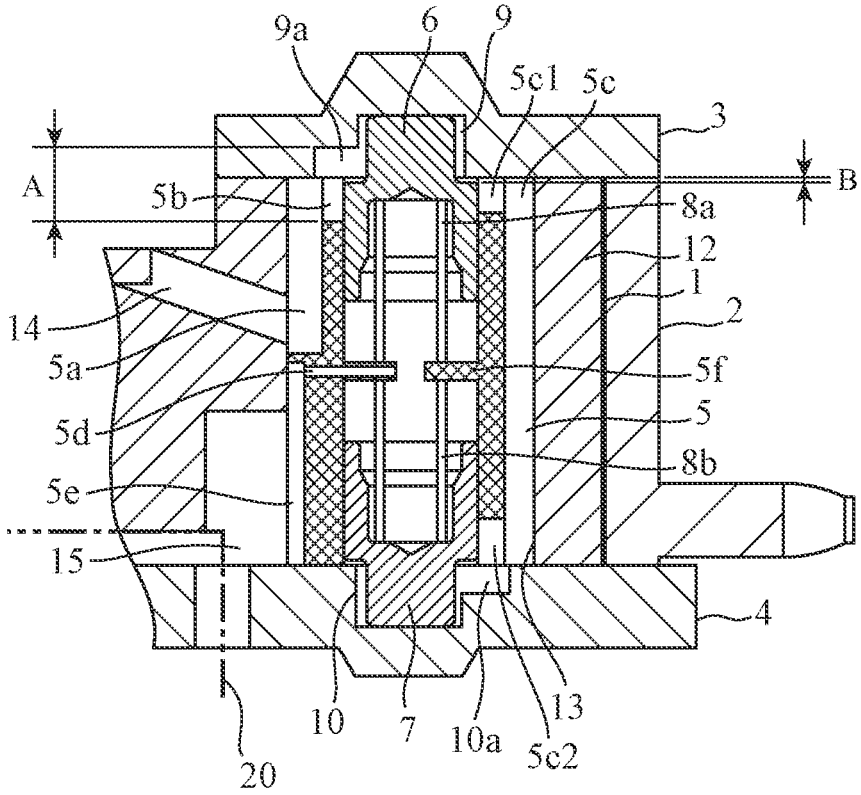
FIG. 10 is a cross-sectional view of a lock mechanism of a third embodiment taken along line P-P of FIG. 3, illustrating a locked state.

A valve timing adjustment device 100 according to a third embodiment is structured the same as the valve timing adjustment device 100 according to the first embodiment except for the lock mechanism, and FIGS. 1 to 7 thus also apply to the following description. FIG. 10 is a cross-sectional view of a lock mechanism of the third embodiment taken along line P-P of FIG. 3, illustrating a locked state. In FIG. 10, elements identical or equivalent to the corresponding elements of FIGS. 1 to 9 are indicated by the same reference characters, and a description thereof will be omitted.

In the first embodiment, the press-fit member 5 is structured to have the cutout portion 5*b*, but in the third embodiment, the recessed portion 9*a* described in the second embodiment is also formed in addition to this cutout portion 5*b*. Specifically, the advance-side engagement groove 9 has the recessed portion 9*a*, which is a recess formed in a portion facing the cutout portion 5*b* of the press-fit member 5. Formation of the cutout portion 5*b* and the recessed portion 9*a* permits the advance-side lock pin-release oil passage 5*a* and the advance-side engagement groove 9 to communicate with each other. The lock pin-release hydraulic pressure applied to the rotor-side lock pin-release oil passage 14 is applied from the rotor-side lock pin-release oil passage 14 through the advance-side lock pin-release oil passage 5*a*, through the cutout portion 5*b*, and through the recessed portion 9*a* to the advance-side engagement groove 9.

Note that similarly to the configuration on the advance side, the recessed portion 10*a* may be formed in the retard-side engagement groove 10 also on the retard side in addition to the cutout portion 5*c*2. The lock pin-release hydraulic pressure applied to the advance-side engagement groove 9 is applied from the advance-side engagement groove 9 through the cutout portion 5*c*1, through the retard-side lock pin-release oil passage 5*c*, through the cutout portion 5*c*2, and through the recessed portion 10*a* to the retard-side engagement groove 10.

Let "A" denote the length that is the sum of the length of the cutout portion 5*b* and the length of the recessed portion 9*a* in the axial direction of the casing 2. In addition, similarly to the first embodiment, let "B" denote the length of the clearance between the advance-side lock pin 6 and the advance-side engagement groove 9 in the axial direction of the casing 2. The magnitude relationship between A and B is A>B in the locked state illustrated in FIG. 10, and A≤B in the unlocked state (not shown). This magnitude relationship ensures that the retard-side lock pin-release oil passage 5*c* will not be established unless the advance-side lock pin 6 is disengaged in the locked state of FIG. 10, thereby enabling the advance-side lock pin 6 to be reliably disengaged.

As described above, the press-fit member 5 of the third embodiment has the cutout portion 5*b*, formed by cutting out a portion facing the advance-side engagement groove 9 in the advance-side lock pin-release oil passage 5*a*. In addition, the advance-side engagement groove 9 has the recessed portion 9*a*, which is a recess formed in a portion facing the cutout portion 5*b*. In this configuration, when the advance-side lock pin 6 is engaged with the advance-side engagement groove 9, the length B of the clearance between the advance-side lock pin 6 and the advance-side engagement groove 9, the clearance communicating with the retard-side lock pin-release oil passage 5*c*, is less than the length A, which is the sum of the length of the cutout portion 5*b* and the length of the recessed portion 9*a*, in the axial direction of the casing 2. Meanwhile, when the advance-side lock pin 6 is disengaged from the advance-side engagement groove 9, the length B of the clearance between the advance-side lock pin 6 and the advance-side engagement groove 9, the clearance communicating with the retard-side lock pin-release oil passage 5*c*, is greater than or equal to the length A, which is the sum of the length of the cutout portion 5*b* and the length of the recessed portion 9*a*, in the axial direction of the casing 2. This enables the advance-side lock pin 6 to be reliably disengaged before the retard-side lock pin 7.

In addition, one coil spring 8 is used in the first embodiment, but in the third embodiment, two coil springs 8*a* and 8*b* are used. The coil spring 8*a*, corresponding to a first coil spring, biases the advance-side lock pin 6 toward the advance-side engagement groove 9. The coil spring 8*b*, corresponding to a second coil spring, biases the retard-side lock pin 7 toward the retard-side engagement groove 10. Note that the biasing force of the coil spring 8*b* may be greater than the biasing force of the coil spring 8*a*. This can prevent a situation in which, during an unlocking operation, the retard-side lock pin 7 is disengaged from the retard-side engagement groove 10 before the advance-side lock pin 6 is disengaged from the advance-side engagement groove 9 even if the lock pin-release hydraulic pressure leaks through the clearance to the retard-side engagement groove 10.

Fourth Embodiment

Figure 11:
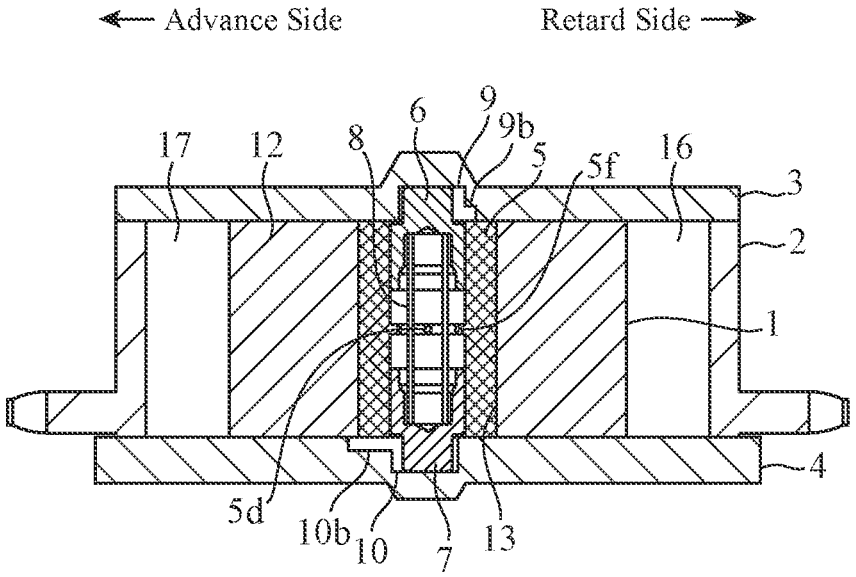
FIG. 11 is a cross-sectional view of a lock mechanism of a fourth embodiment taken along line Q-Q of FIG. 3, illustrating a locked state.
Figure 12:
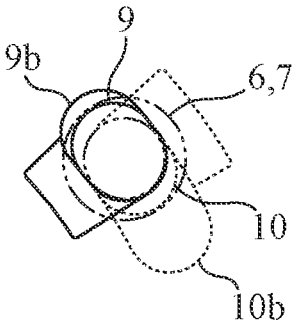
FIG. 12 is a front view illustrating an example of formation of an advance-side engagement groove and of a retard-side engagement groove of the fourth embodiment.

A valve timing adjustment device 100 according to a fourth embodiment is structured the same as the valve timing adjustment device 100 according to the first embodiment except for the lock mechanism, and FIGS. 1 to 7 thus also apply to the following description. FIG. 11 is a cross-sectional view of a lock mechanism of the fourth embodiment taken along line Q-Q of FIG. 3, illustrating a locked state. FIG. 12 is a front view illustrating an example of formation of an advance-side engagement groove 9 and of a retard-side engagement groove 10 of the fourth embodiment.

In the first embodiment, the depth of each of the advance-side engagement groove 9 and the retard-side engagement groove 10 is constant in the relative rotational direction, but in the fourth embodiment, the advance-side engagement groove 9 includes a stepped portion 9*b* having at least one step formed on the retard side to cause the advance-side engagement groove 9 to have a stepped depth. In addition, the retard-side engagement groove 10 has a stepped portion 10*b* having at least one step formed on the advance side to cause the retard-side engagement groove 10 to have a stepped depth. Note that the depth may be stepped only on the advance side or on the retard side, or the depth may be stepped on both the advance and retard sides. When either the advance-side lock pin 6 or the retard-side lock pin 7 is in an engaged state, this causes the advance-side lock pin 6 or the retard-side lock pin 7 to abut a wall formed by the advance-side engagement groove 9 and the stepped portion 9*b*, or a wall formed by the retard-side engagement groove 10 and the stepped portion 10*b* even if the valve timing adjustment device 100 is subject to vibration, and thereby prevents relative rotation of the rotor 1.

Note that the valve timing adjustment devices 100 according to the second embodiment and the third embodiment may also be structured so that the stepped portion 9*b* and the stepped portion 10*b* are respectively formed in the advance-side engagement groove 9 and in the retard-side engagement groove 10.

Fifth Embodiment

Figure 13:
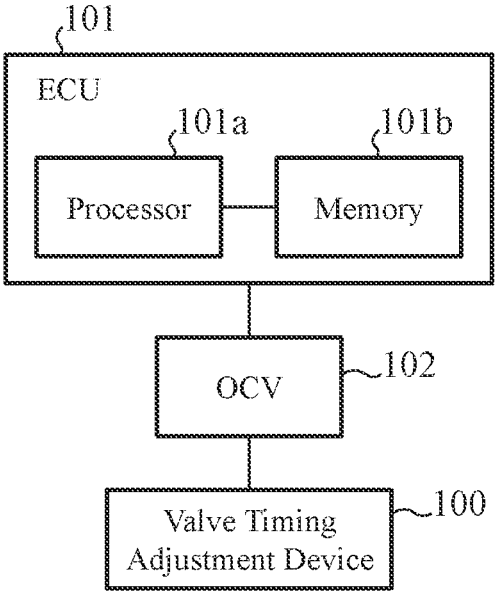
FIG. 13 is a diagram illustrating an example configuration in relation to control of operation of a valve timing adjustment device according to a fifth embodiment.

FIG. 13 is a diagram illustrating an example configuration in relation to control of operation of a valve timing adjustment device 100 according to a fifth embodiment. The valve timing adjustment device 100 according to the fifth embodiment is structured the same as the valve timing adjustment devices 100 according to the first to fourth embodiments, and FIGS. 1 to 12 thus also apply to the following description. A valve timing adjustment system illustrated in FIG. 13 includes an engine control unit 101 (hereinafter referred to as "ECU 101"), which is a control device for the valve timing adjustment device 100, the OCV 102, and the valve timing adjustment device 100.

The ECU 101 controls the operation of the OCV 102 to switch the status of communication between the OCV 102 and the rotor-side lock pin-release oil passage 14, the status of communication between the OCV 102 and the advancing oil passages 18, and the status of communication between the OCV 102 and the retarding oil passages 19. The OCV 102 supplies oil supplied from an oil pump (not shown) to the rotor-side lock pin-release oil passage 14, to the advancing oil passages 18, or to the retarding oil passages 19 in accordance with the control by the ECU 101. In addition, the OCV 102 drains the oil supplied to the rotor-side lock pin-release oil passage 14, to the advancing oil passages 18, or to the retarding oil passages 19 along a path opposite to the path used in the supply operation in accordance with the control by the ECU 101.

The ECU 101 is a computer or a microcomputer including a processor 101*a* and a memory 101*b*. The functions of the ECU 101 are implemented by software, firmware, or a combination of software and firmware. The software or firmware is described as a program, and is stored in the memory 101*b*. The processor 101*a* reads and executes the program stored in the memory 101*b* to implement the functions of the ECU 101. Specifically, the ECU 101 includes the memory 101*b* for storing a program that, upon execution by the processor 101*a*, causes the steps illustrated in the flowcharts of FIGS. 18 and 23 mentioned later to be performed. In addition, it can also be said that this program causes the computer or the microcomputer to perform the procedure or the method illustrated in the flowcharts of FIGS. 18 and 23 mentioned later.

A method for controlling the valve timing adjustment device 100 by the ECU 101 will next be described.

First, a procedure to unlock the lock mechanism will be described with reference to the lock mechanism of FIGS. 14 to 17, the flowchart of FIG. 18, and the graphs of FIG. 19. Note that in the description of the fifth embodiment, the valve timing adjustment device 100 according to the fourth embodiment is used by way of example.

Figure 14A:
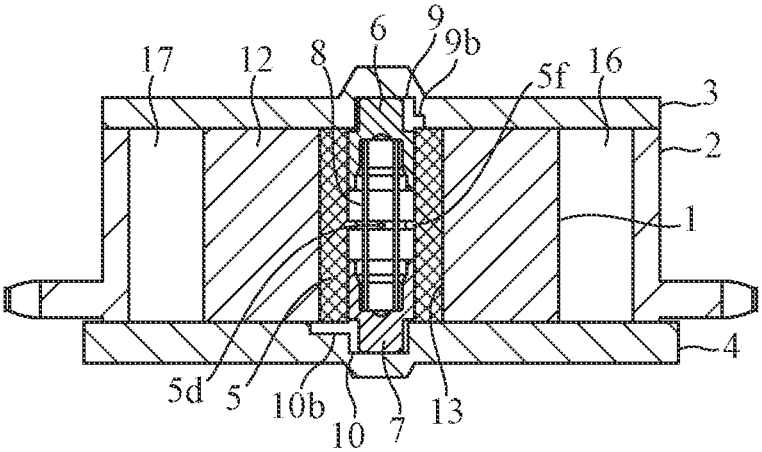
FIG. 14A is a cross-sectional view taken along line Q-Q of FIG. 3.
Figure 14B:
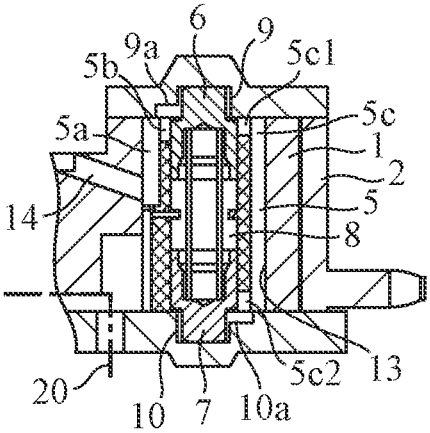
FIG. 14B is a cross-sectional view taken along line P-P of FIG. 3.
Figure 15A:
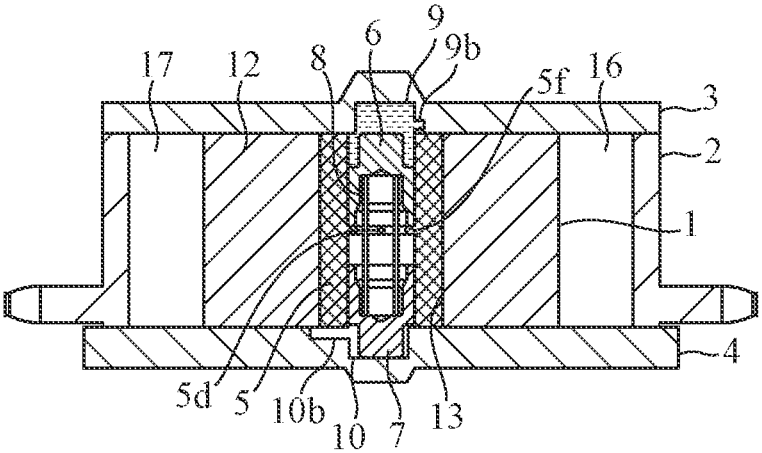
FIG. 15A is a cross-sectional view taken along line Q-Q of FIG. 3.
Figure 15B:
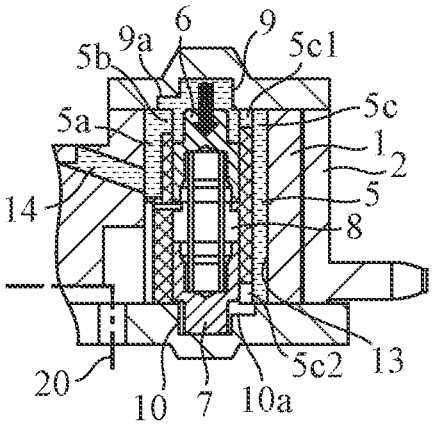
FIG. 15B is a cross-sectional view taken along line P-P of FIG. 3.
Figure 16A:
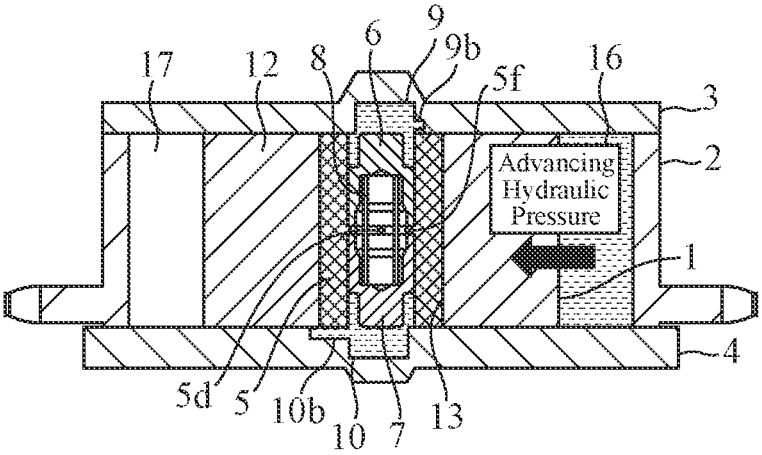
FIG. 16A is a cross-sectional view taken along line Q-Q of FIG. 3.
Figure 16B:
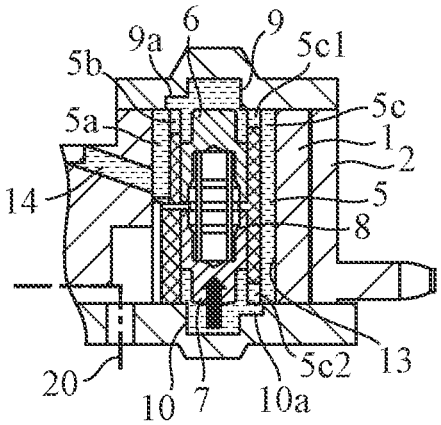
FIG. 16B is a cross-sectional view taken along line P-P of FIG. 3.
Figure 17A:
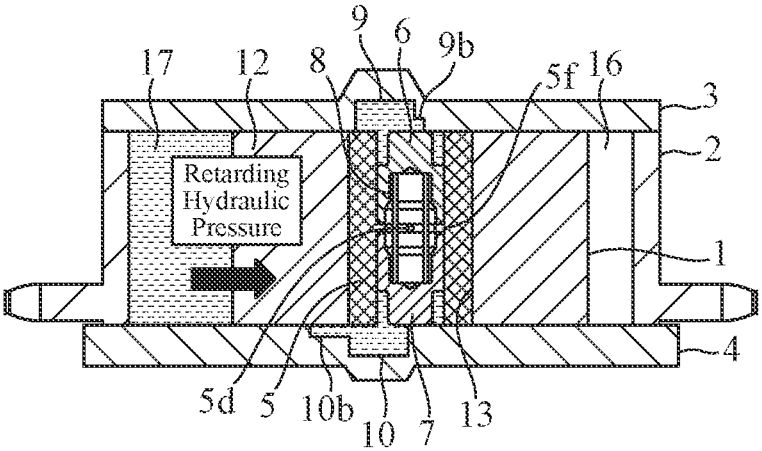
FIG. 17A is a cross-sectional view taken along line Q-Q of FIG. 3.
Figure 17B:
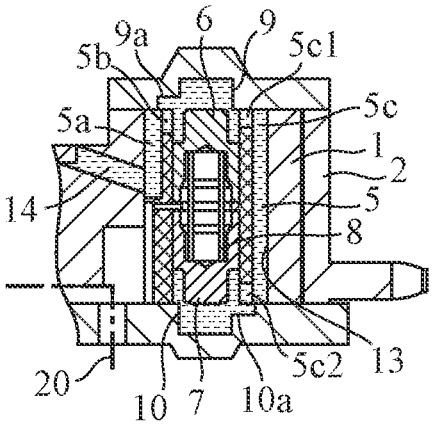
FIG. 17B is a cross-sectional view taken along line P-P of FIG. 3.

FIG. 14 is a set of views illustrating a state in which the valve timing adjustment device 100 is locked in an intermediate position; FIG. 14A is a cross-sectional view taken along line Q-Q of FIG. 3, and FIG. 14B is a cross-sectional view taken along line P-P of FIG. 3. FIG. 15 is a set of views illustrating a state in which the advance-side lock pin 6 is disengaged and the retard-side lock pin-release oil passage 5*c* is opened; FIG. 15A is a cross-sectional view taken along line Q-Q of FIG. 3, and FIG. 15B is a cross-sectional view taken along line P-P of FIG. 3. FIG. 16 is a set of views illustrating a state in which not only the advance-side lock pin 6 but also the retard-side lock pin 7 is disengaged; FIG. 16A is a cross-sectional view taken along line Q-Q of FIG. 3, and FIG. 16B is a cross-sectional view taken along line P-P of FIG. 3. FIG. 17 is a set of views illustrating a state in which the rotor 1 receives retarding hydraulic pressure, and thus moves in the retard direction; FIG. 17A is a cross-sectional view taken along line Q-Q of FIG. 3, and FIG. 17B is a cross-sectional view taken along line P-P of FIG. 3.

Figure 18:
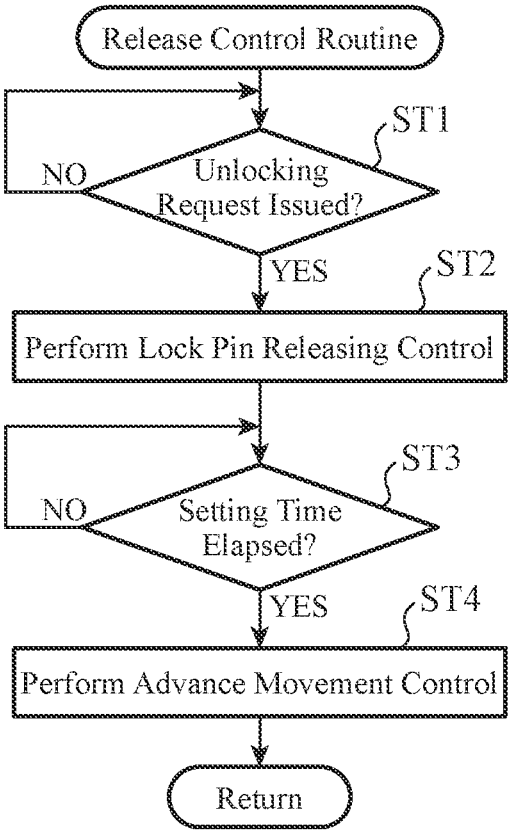
FIG. 18 is a flowchart illustrating a procedure to unlock the valve timing adjustment device according to the fifth embodiment.
Figure 19:
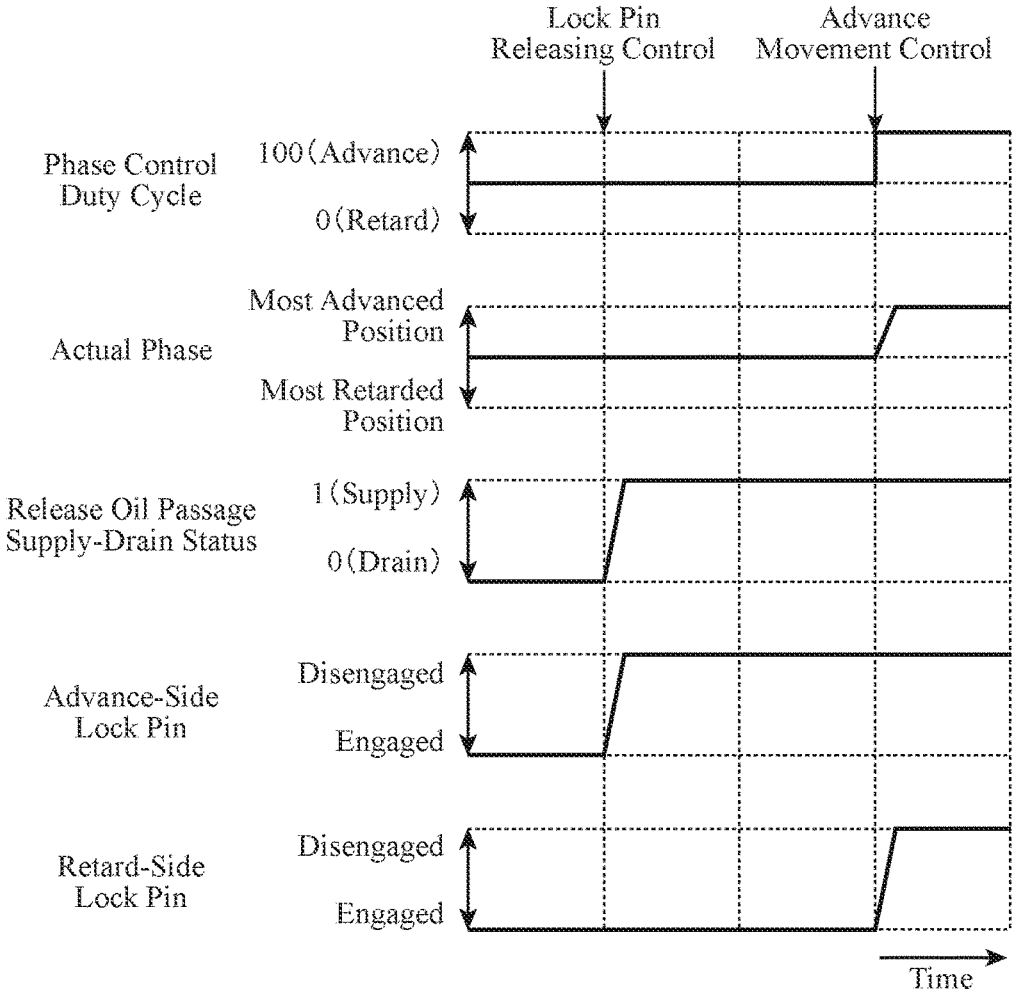
FIG. 19 is a set of graphs illustrating a phase control duty cycle, an actual phase, a release oil passage supply-drain status, an engagement status of the advance-side lock pin, and an engagement status of the retard-side lock pin during the unlocking operation in the fifth embodiment.

In addition, FIG. 18 is a flowchart illustrating a procedure to unlock the valve timing adjustment device 100 according to the fifth embodiment. FIG. 19 is a set of graphs illustrating a phase control duty cycle, an actual phase, a release oil passage supply-drain status, an engagement status of the advance-side lock pin 6, and an engagement status of the retard-side lock pin 7 during the unlocking operation in the fifth embodiment. The phase control duty cycle is a value for controlling the current of the OCV 102. An adjustment of the phase control duty cycle by the ECU 101 causes the hydraulic pressure in the advancing hydraulic chambers 16 and in the retarding hydraulic chambers 17 to be controlled. The actual phase is a relative rotation angle of the camshaft 20 with respect to the crankshaft, obtained from a detected value of an angle sensor or the like. The release oil passage supply-drain status is a value that indicates the status of the oil supplied or drained from/to the OCV 102 to/from the rotor-side lock pin-release oil passage 14, and a higher value indicates a greater amount of oil being supplied to the rotor-side lock pin-release oil passage 14. The release oil passage supply-drain status is controlled by the ECU 101. The engagement statuses indicate the positional relationship of the advance-side lock pin 6, which moves depending on the release oil passage supply-drain status, with respect to the advance-side engagement groove 9, and the positional relationship of the retard-side lock pin 7 with respect to the retard-side engagement groove 10. "Engaged" indicates the state in which the lock pin has moved toward, and is completely fit into, the engagement groove, and "Disengaged" indicates the state in which the lock pin has been withdrawn from, and has completely come out of, the engagement groove.

Upon start-up of the engine when the rotor 1 is locked in an intermediate position, that is, when the advance-side lock pin 6 and the retard-side lock pin 7 are respectively engaged with the advance-side engagement groove 9 and with the retard-side engagement groove 10 as illustrated in FIGS. 14A and 14B, an unlocking request is provided from the vehicle side to the ECU 101.

At step ST1, when an unlocking request is received from the vehicle side ("YES" at step ST1), the ECU 101 causes the process to proceed to step ST2, and repeats step ST1 in the other cases ("NO" at step ST1).

At step ST2, the ECU 101 performs lock pin releasing control. Specifically, the ECU 101 controls the OCV 102 to apply lock pin-release hydraulic pressure to the rotor-side lock pin-release oil passage 14. The lock pin-release hydraulic pressure is applied through the rotor-side lock pin-release oil passage 14, through the advance-side lock pin-release oil passage 5*a*, and through the cutout portion 5*b* to the advance-side engagement groove 9. Then, as illustrated in FIG. 15A, the lock pin-release hydraulic pressure applied to the advance-side engagement groove 9 acts on the advance-side lock pin 6 to cause the advance-side lock pin 6 to disengage from the advance-side engagement groove 9. In addition, as illustrated in FIG. 15B, a clearance is formed between the advance-side lock pin 6 and the advance-side engagement groove 9, and thus the retard-side lock pin-release oil passage 5*c* is opened, thereby allowing the lock pin-release hydraulic pressure to be applied from the advance-side engagement groove 9 to the retard-side lock pin-release oil passage 5*c*.

At step ST3, the ECU 101 starts measurement of time upon the start of performing the lock pin releasing control, and determines whether a predetermined setting time has elapsed. If the setting time has elapsed ("YES" at step ST3), the ECU 101 causes the process to proceed to step ST4, and repeats step ST3 if the setting time has not yet elapsed ("NO" at step ST3). The setting time is the required time until the advance-side lock pin 6 is disengaged from the advance-side engagement groove 9 after the lock pin-release hydraulic pressure is applied to the rotor-side lock pin-release oil passage 14. In the graphs of FIG. 19, the setting time corresponds to the time period from "lock pin releasing control" to "advance movement control". Note that the ECU 101 may change the predetermined setting time as appropriate depending on the hydraulic pressure, the oil temperature, and the like.

At step ST4, the ECU 101 performs advance movement control. Specifically, the ECU 101 controls the OCV 102 to apply hydraulic pressure to the advancing oil passages 18. This hydraulic pressure is applied through the advancing oil passages 18 to the advancing hydraulic chambers 16. As described above, the retard-side lock pin 7 receives cam torque and is thus pressed on a retard-side side wall of the retard-side engagement groove 10, and is accordingly not easy to come out. When the advance movement control causes the rotor 1 to move in the advance direction as illustrated in FIG. 16A, the retard-side lock pin 7 separates from the side wall of the retard-side engagement groove 10 and thereby the contact therebetween is broken, thus making the retard-side lock pin 7 disengageable. Then, as illustrated in FIG. 16B, the lock pin-release hydraulic pressure applied from the retard-side lock pin-release oil passage 5*c* to the retard-side engagement groove 10 acts on the retard-side lock pin 7 to cause the retard-side lock pin 7 to disengage from the retard-side engagement groove 10.

The control by the ECU 101 at steps ST1 to ST4 disengages the advance-side lock pin 6 and the retard-side lock pin 7, and thus releases the intermediate lock of the rotor 1. Then, to provide the intended actual phase, the ECU 101 controls the OCV 102 to apply hydraulic pressure to the advancing hydraulic chambers 16 or to the retarding hydraulic chambers 17, and thus causes the rotor 1 to move in the advance direction or in the retard direction.

Figure 21:
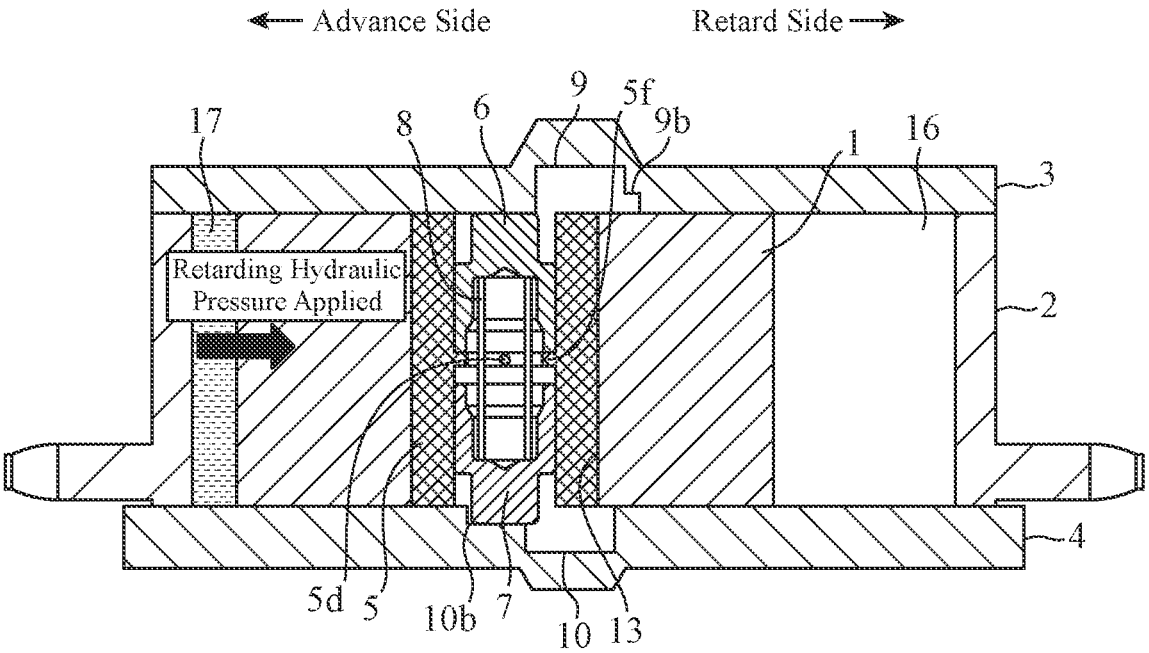
FIG. 21 is a view illustrating a state in which the retard-side lock pin is engaged with a stepped portion of the retard-side engagement groove, and is a cross-sectional view taken along line Q-Q of FIG. 3.
Figure 22:
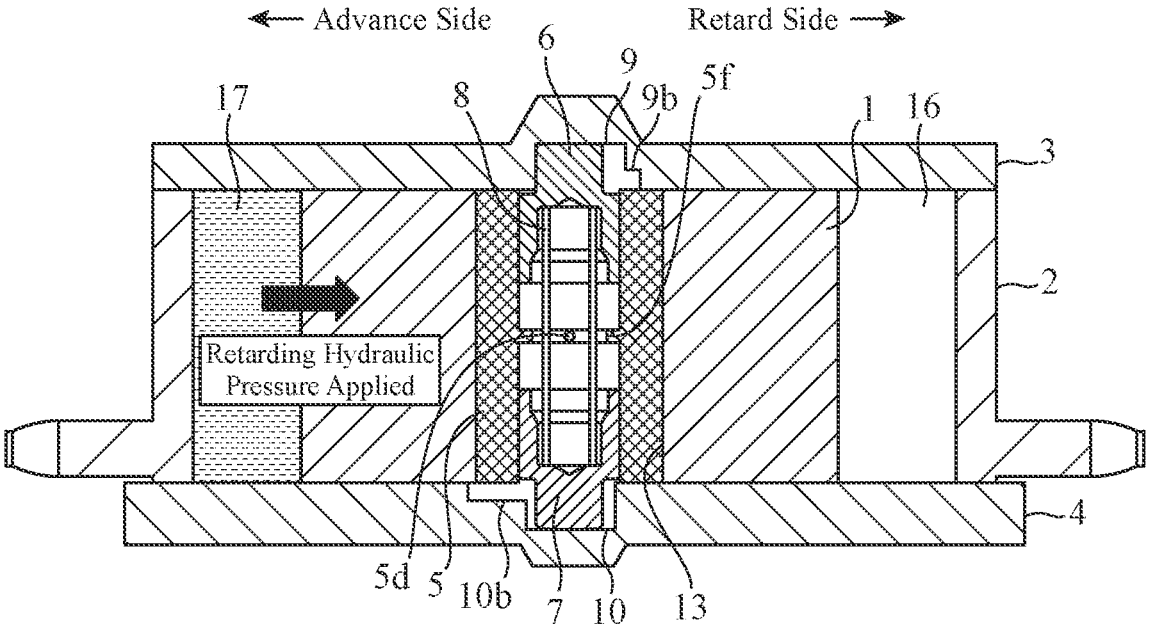
FIG. 22 is a view illustrating a state in which the valve timing adjustment device is locked in an intermediate position, and is a cross-sectional view taken along line Q-Q of FIG. 3.

A procedure to lock the lock mechanism will next be described with reference to the lock mechanism of FIGS. 20 to 22, the flowchart of FIG. 23, and the graphs of FIG. 24.

Figure 20:
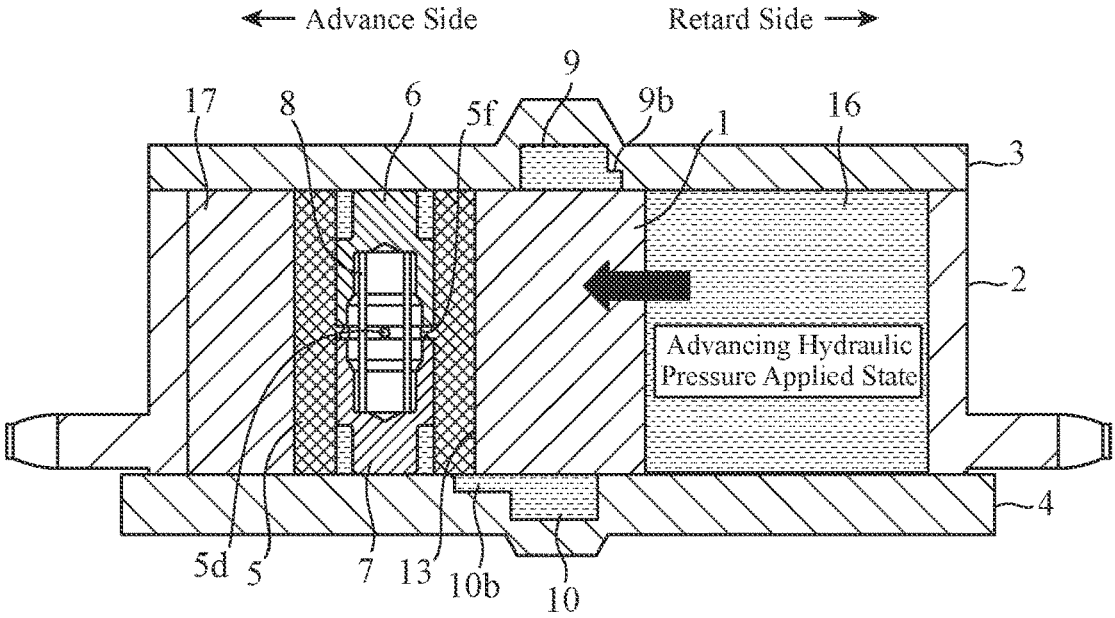
FIG. 20 is a view illustrating a state in which the rotor is positioned on the advance side, and is a cross-sectional view taken along line Q-Q of FIG. 3.

FIG. 20 is a view illustrating a state in which the rotor 1 is positioned on the advance side, and is a cross-sectional view taken along line Q-Q of FIG. 3. FIG. 21 is a view illustrating a state in which the retard-side lock pin 7 is engaged with the stepped portion 10*b* of the retard-side engagement groove 10, and is a cross-sectional view taken along line Q-Q of FIG. 3. FIG. 22 is a view illustrating a state in which the valve timing adjustment device 100 is locked in an intermediate position, and is a cross-sectional view taken along line Q-Q of FIG. 3.

Figure 23:
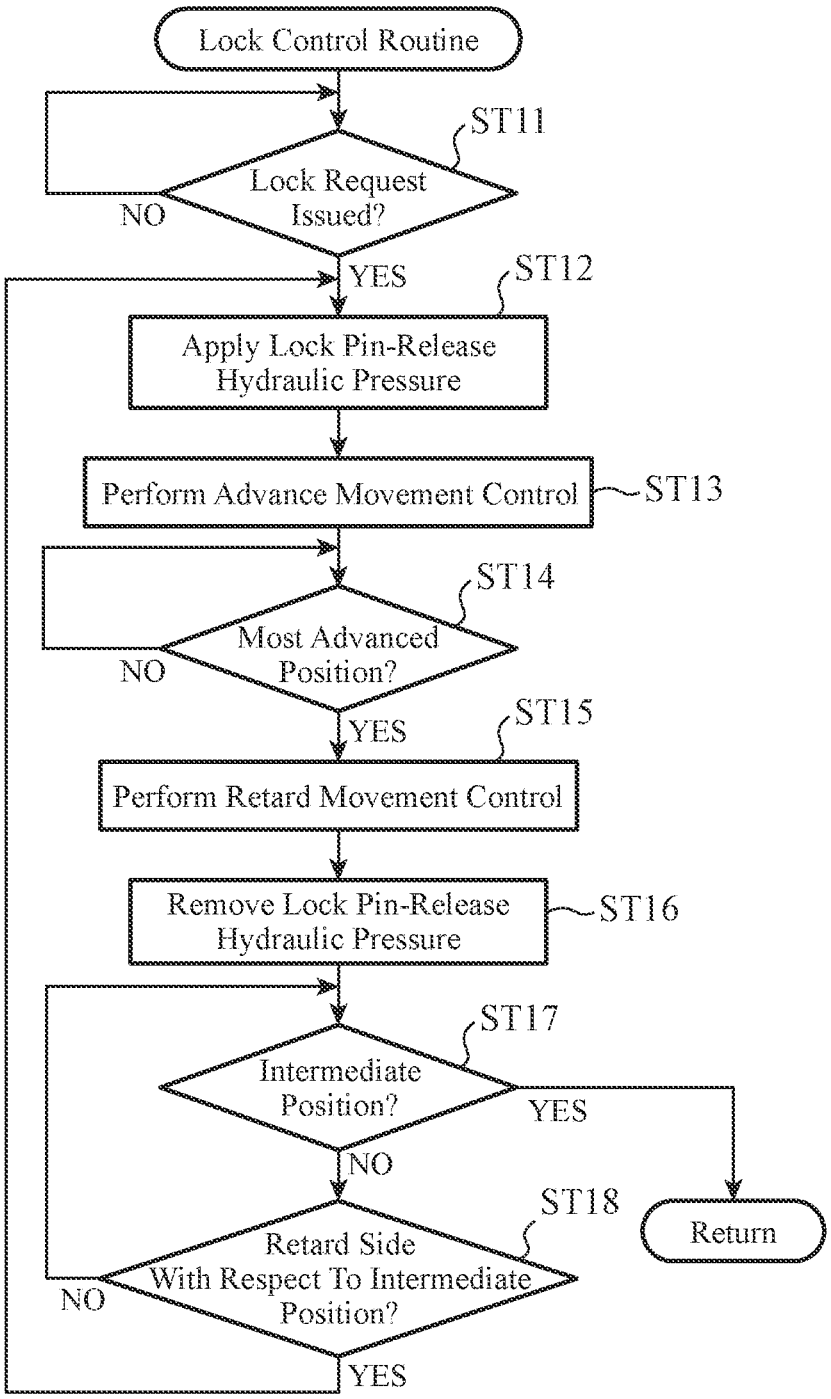
FIG. 23 is a flowchart illustrating a procedure to lock the valve timing adjustment device according to the fifth embodiment.
Figure 24:
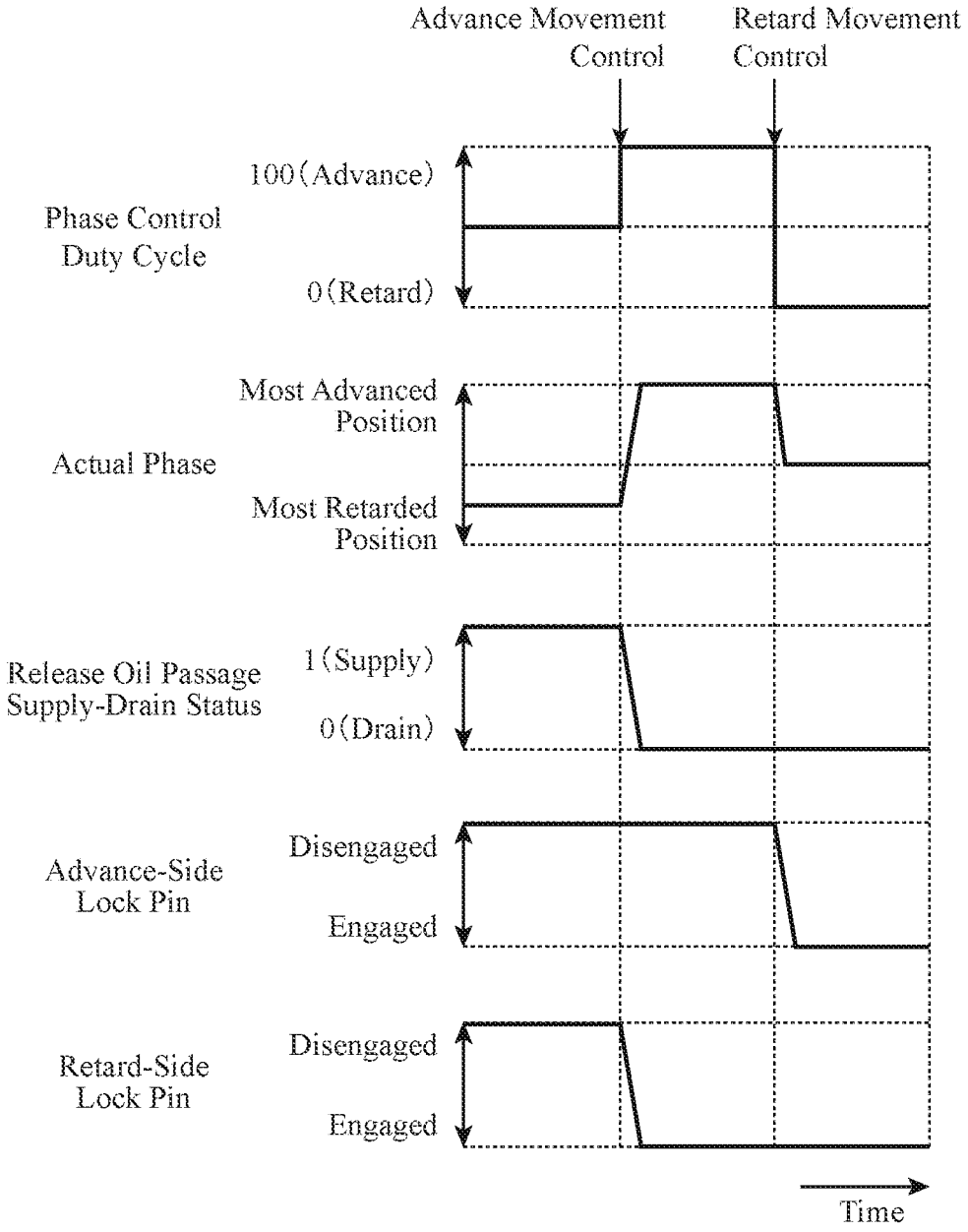
FIG. 24 is a set of graphs illustrating a phase control duty cycle, an actual phase, a release oil passage supply-drain status, an engagement status of the advance-side lock pin, and an engagement status of the retard-side lock pin during the lock operation in the fifth embodiment.

FIG. 23 is a flowchart illustrating a procedure to lock the valve timing adjustment device 100 according to the fifth embodiment. FIG. 24 is a set of graphs illustrating a phase control duty cycle, an actual phase, a release oil passage supply-drain status, an engagement status of the advance-side lock pin 6, and an engagement status of the retard-side lock pin 7 during the lock operation in the fifth embodiment.

Upon stopping of the engine when the advance-side lock pin 6 and the retard-side lock pin 7 are both disengaged and thus the rotor 1 is movable in the advance direction and in the retard direction, a lock request is provided from the vehicle side to the ECU 101.

At step ST11, when a lock request is received from the vehicle side ("YES" at step ST11), the ECU 101 causes the process to proceed to step ST12, and repeats step ST11 in the other cases ("NO" at step ST11).

At step ST12, the ECU 101 controls the OCV 102 to apply lock pin-release hydraulic pressure to the rotor-side lock pin-release oil passage 14, and thus causes the lock pin-release hydraulic pressure to be applied to the advance-side engagement groove 9 and to the retard-side engagement groove 10. This prevents the advance-side lock pin 6 and the retard-side lock pin 7 from being accidentally engaged respectively with the advance-side engagement groove 9 and the retard-side engagement groove 10 during advance movement of the rotor 1 at step ST13 that follows.

At step ST13, the ECU 101 performs advance movement control. Specifically, the ECU 101 controls the OCV 102 to apply hydraulic pressure through the advancing oil passages 18 to the advancing hydraulic chambers 16, and to remove hydraulic pressure in the retarding hydraulic chambers 17 through the retarding oil passages 19, and thus causes the rotor 1 to move to the most advanced position.

At step ST14, the ECU 101 determines whether the actual phase has reached the most advanced position as illustrated in FIG. 20. If the actual phase is the most advanced position ("YES" at step ST14), the ECU 101 causes the process to proceed to step ST15, and repeats step ST14 if the actual phase is not the most advanced position ("NO" at step ST14).

At step ST15, the ECU 101 performs retard movement control. Specifically, the ECU 101 controls the OCV 102 to apply hydraulic pressure through the retarding oil passages 19 to the retarding hydraulic chambers 17, and to remove hydraulic pressure in the advancing hydraulic chambers 16 through the advancing oil passages 18. This causes the rotor 1 to move in the retard direction as illustrated in FIG. 21.

At step ST16, the ECU 101 controls the OCV 102 to remove the lock pin-release hydraulic pressure in the advance-side engagement groove 9 and in the retard-side engagement groove 10 through the rotor-side lock pin-release oil passage 14, concurrently with the retard movement control at step ST15. This causes the rotor 1 to move in the retard direction, and thus causes the retard-side lock pin 7 to first engage with the stepped portion 10*b* as illustrated in FIG. 21, and then with the retard-side engagement groove 10. Abutment of the retard-side lock pin 7 on the retard-side side wall of the retard-side engagement groove 10 restricts further retard movement of the rotor 1 beyond the intermediate position, and also causes the advance-side lock pin 6 to engage with the advance-side engagement groove 9. This causes the rotor 1 to be locked in the intermediate position as illustrated in FIG. 22.

At step ST17, the ECU 101 determines whether the actual phase has stopped at the intermediate position. If the actual phase is at the intermediate position ("YES" at step ST17), the ECU 101 determines that the rotor 1 is locked in the intermediate position, in which case the advance-side lock pin 6 is engaged with the advance-side engagement groove 9, and the retard-side lock pin 7 is engaged with the retard-side engagement groove 10 as illustrated in FIG. 22, and thus terminates the process illustrated in the flowchart of FIG. 23. Otherwise, if the actual phase is not at the intermediate position ("NO" at step ST17), the ECU 101 causes the process to proceed to step ST18. When the actual phase is not at the intermediate position, the advance-side lock pin 6 and the retard-side lock pin 7 are not respectively engaged with the advance-side engagement groove 9 and the retard-side engagement groove 10.

At step ST18, the ECU 101 determines whether the actual phase is on the retard side with respect to the intermediate position. If the actual phase is on the retard side with respect to the intermediate position, this indicates that engagement has failed due to the advance-side lock pin 6 and the retard-side lock pin 7 passing over the advance-side engagement groove 9 and the retard-side engagement groove 10 before the lock pin-release hydraulic pressure is fully removed from the advance-side engagement groove 9 and from the retard-side engagement groove 10, or engagement has been unsuccessful even though the lock pin-release hydraulic pressure has been fully removed. Accordingly, if the actual phase is on the retard side with respect to the intermediate position ("YES" at step ST18), the ECU 101 causes the process to return to step ST12, and then performs the lock control routine again. Otherwise, if the actual phase is not on the retard side with respect to the intermediate position, this indicates that the advance-side lock pin 6 and the retard-side lock pin 7 have not yet reached the advance-side engagement groove 9 and the retard-side engagement groove 10. Accordingly, if the actual phase is not on the retard side with respect to the intermediate position ("NO" at step ST18), the ECU 101 causes the process to return to step ST17.

As described above, when the intermediate lock of the rotor 1 is to be unlocked in the fifth embodiment, the ECU 101 causes lock pin-release hydraulic pressure to be applied to the advance-side lock pin-release oil passage 5*a* thus to disengage the advance-side lock pin 6 from the advance-side engagement groove 9, thereby making the rotor 1 rotatable in the advance direction, and at the same time, forming a clearance communicating with the retard-side lock pin-release oil passage 5*c*, between the advance-side lock pin 6 and the advance-side engagement groove 9. Next, the ECU 101 causes hydraulic pressure to be applied to the advancing hydraulic chambers 16 thus to rotate the rotor 1, and causes the lock pin-release hydraulic pressure in the advance-side engagement groove 9 to be applied through the clearance and through the retard-side lock pin-release oil passage 5*c* to the retard-side engagement groove 10 to disengage the retard-side lock pin 7. Thus, the ECU 101 can reduce the time required to unlock the intermediate lock, and to allow the valve timing adjustment device 100 to operate, and can thus enhance responsivity as compared to conventional ones.

In addition, when the rotor 1 is to be locked by the intermediate lock in the fifth embodiment, the ECU 101 causes lock pin-release hydraulic pressure to be applied to the advance-side engagement groove 9 and to the retard-side engagement groove 10, and then causes hydraulic pressure to be applied to the advancing hydraulic chambers 16, thereby causing the rotor 1 to rotate to the most advanced position. Next, the ECU 101 causes the lock pin-release hydraulic pressure to be removed from the advance-side engagement groove 9 and from the retard-side engagement groove 10, and causes hydraulic pressure to be applied to the retarding hydraulic chambers 17 to rotate the rotor 1 toward the intermediate position, thereby engaging the advance-side lock pin 6 with the advance-side engagement groove 9 and engaging the retard-side lock pin 7 with the retard-side engagement groove 10. Thus, by moving the rotor 1 from the most advanced position in the retard direction, the ECU 101 allows the advance-side lock pin 6 and the retard-side lock pin 7 to automatically engage with the advance-side engagement groove 9 and with the retard-side engagement groove 10.

Sixth Embodiment

Figure 25:
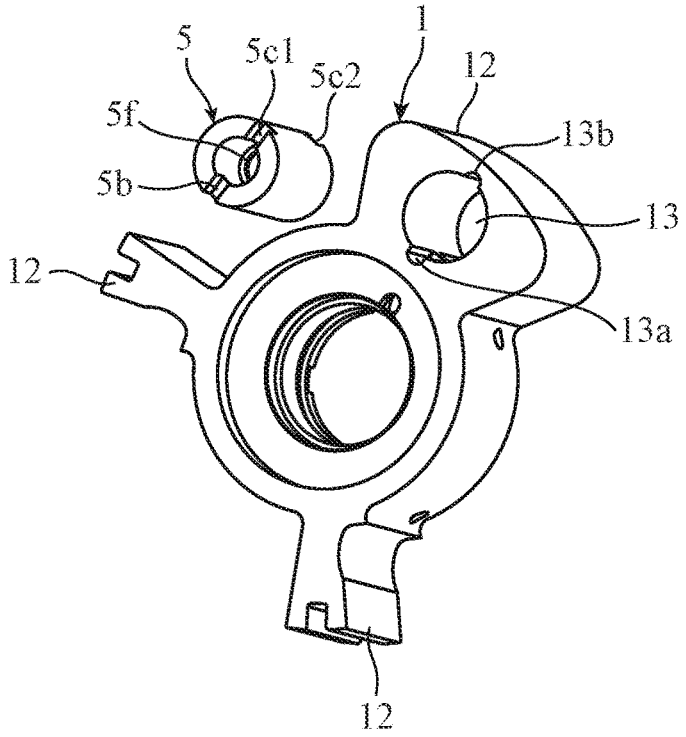
FIG. 25 is an exploded perspective view illustrating an example configuration of a rotor and of a press-fit member of a valve timing adjustment device according to a sixth embodiment.
Figure 26:
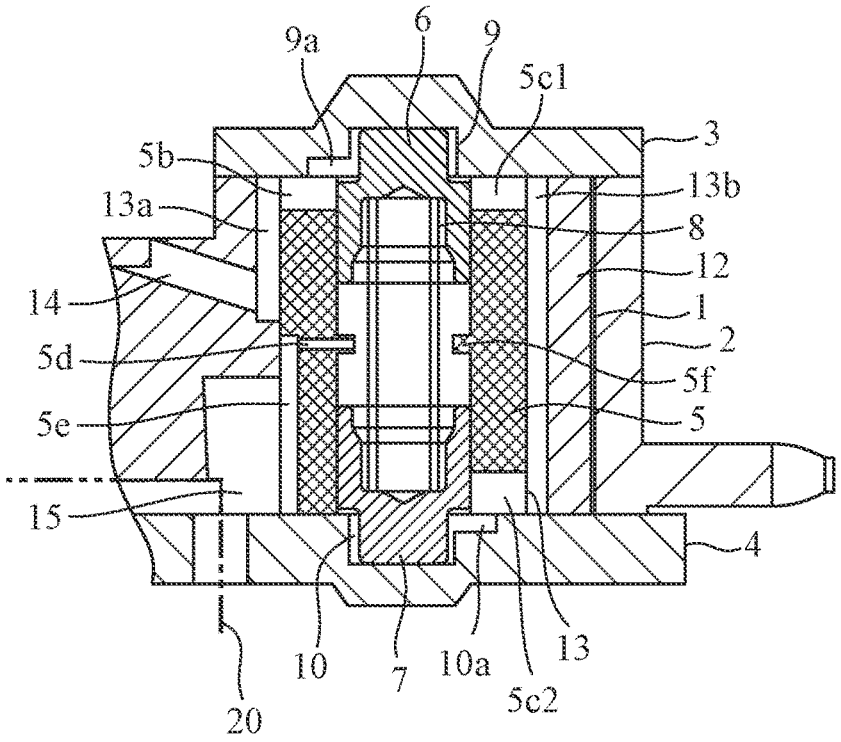
FIG. 26 is a cross-sectional view of a lock mechanism of the sixth embodiment taken along line P-P of FIG. 3, illustrating a locked state.

A valve timing adjustment device 100 according to a sixth embodiment is structured the same as the valve timing adjustment devices 100 according to the first to fourth embodiments except for the lock mechanism, and FIGS. 1 to 12 thus also apply to the following description. FIG. 25 is an exploded perspective view illustrating an example configuration of a rotor 1 and of a press-fit member 5 of the valve timing adjustment device 100 according to the sixth embodiment. FIG. 26 is a cross-sectional view of a lock mechanism of the sixth embodiment taken along line P-P of FIG. 3, illustrating a locked state.

In the first to fourth embodiments, the press-fit member 5 is structured to have the advance-side lock pin-release oil passage 5*a*, but in the sixth embodiment, the through hole 13 is structured to have an advance-side lock pin-release oil passage 13*a*. As illustrated in FIGS. 25 and 26, the inner circumferential surface of the through hole 13 has a groove formed therein that extends from the rotor-side lock pin-release oil passage 14 to the cutout portion 5*b* of the press-fit member 5, and this groove is the advance-side lock pin-release oil passage 13*a*.

Similarly, the press-fit member 5 is structured to have the retard-side lock pin-release oil passage 5*c*, but the through hole 13 may be structured to have a retard-side lock pin-release oil passage 13*b*. As illustrated in FIGS. 25 and 26, the inner circumferential surface of the through hole 13 has a groove formed therein that extends from the advance-side engagement groove 9 to the retard-side engagement groove 10, and this groove is the retard-side lock pin-release oil passage 13*b*.

In the sixth embodiment, the simply-shaped longitudinal grooves formed in the inner circumferential surface of the through hole 13 serve as the advance-side lock pin-release oil passage 13*a* and the retard-side lock pin-release oil passage 13*b*. This eliminates the need for producing a lock pin-release oil passage having a complex shape inside the vane 12.

The foregoing description describes the advance side as the "first" side, which is the upstream side where the lock pin-release hydraulic pressure is applied first, and the retard side as the "second" side, which is the downstream side. Accordingly, the term "first lock pin" corresponds to the advance-side lock pin 6, and the term "second lock pin" corresponds to the retard-side lock pin 7. In addition, the term "first engagement groove" corresponds to the advance-side engagement groove 9, and the term "second engagement groove" corresponds to the retard-side engagement groove 10. Moreover, the term "first lock pin-release oil passage" corresponds to the advance-side lock pin-release oil passage 5*a* or 13*a*, and the term "second lock pin-release oil passage" corresponds to the retard-side lock pin-release oil passage 5*c* or 13*b*.

However, depending on the attachment direction of the valve timing adjustment device 100 to the engine, the advance direction and the retard direction may be opposite. Specifically, the advance-side lock pin 6 and the advance-side engagement groove 9 function as the retard-side lock pin and the retard-side engagement groove, and the retard-side lock pin 7 and the retard-side engagement groove 10 function as the advance-side lock pin and the advance-side engagement groove. In addition, the advance-side lock pin-release oil passages 5*a* and 13*a* each function as the retard-side lock pin-release oil passage, and the retard-side lock pin-release oil passages 5*c* and 13*b* each function as the advance-side lock pin-release oil passage. In this case, the retard side is represented by the term "first", and the advance side is represented by the term "second". In addition, the advance-side lock pin 6 that functions as the retard-side lock pin is to be first disengaged, and the retard-side lock pin 7 that functions as the advance-side lock pin is to then be disengaged. Note that the advance-side lock pin 6 that functions as the retard-side lock pin receives cam torque, and thus is not easy to come out. Accordingly, it is desirable to use the coil spring 8 having a nonlinear spring constant or the two coil springs 8*a* and 8*b* in such a manner that the advance-side lock pin 6 that functions as the retard-side lock pin is biased with less force, and the retard-side lock pin 7 that functions as the advance-side lock pin is biased with greater force, thereby allowing the advance-side lock pin 6 that functions as the retard-side lock pin to be reliably disengaged first.

In a case in which the advance direction and the retard direction are opposite, the ECU 101 performs retard movement control at step ST4 in the flowchart illustrated in FIG. 18; in addition, the ECU 101 performs retard movement control at step ST13 in the flowchart illustrated in FIG. 23, determines whether the actual phase is the most retarded position at step ST14, performs advance movement control at step ST15, and determines whether the actual phase is on the advance side with respect to the intermediate position at step ST18.

Note that the present invention covers any combination of the foregoing embodiments, modification of any component in the embodiments, or omission of any component in the embodiments that falls within the scope of the invention.

INDUSTRIAL APPLICABILITY

A control device for a valve timing adjustment device according to this invention is configured to lock the rotor in an intermediate position by means of two lock pins, and is therefore suitable for use as a control device for a valve timing adjustment device that adjusts opening and closing timings of the intake valve and the exhaust valve of an engine.

REFERENCE SIGNS LIST

1: rotor (second rotary body), 2: casing (first rotary body), 2*a*: sprocket, 3: plate (first rotary body), 4: cover (first rotary body), 5: press-fit member (cylindrical member), 5*a*, 13*a*: advance-side lock pin-release oil passage (first lock pin-release oil passage), 5*b*, 5*c*1, 5*c*2: cutout portion, 5*c*, 13*b*: retard-side lock pin-release oil passage (second lock pin-release oil passage), 5*d*, 5*e*: fluid drain channel, 5*f*: stopper, 6: advance-side lock pin (first lock pin), 7: retard-side lock pin (second lock pin), 8, 8*a*, 8*b*: coil spring (biasing member), 9: advance-side engagement groove (first engagement groove), 9*a*, 10*a*: recessed portion, 9*b*, 10*b*: stepped portion, 10: retard-side engagement groove (second engagement groove), 11: shoe, 12: vane, 13: through hole, 14: rotor-side lock pin-release oil passage, 15: rotor-side fluid drain channel, 16: advancing hydraulic chamber, 17: retarding hydraulic chamber, 18: advancing oil passage, 19: retarding oil passage, 20: camshaft, 100: valve timing adjustment device, 101: ECU (control device), 101*a*: processor, 101*b*: memory, 102: OCV.

The invention claimed is:

1. A control device for a valve timing adjustment device that includes a first rotary body including a hydraulic chamber, a second rotary body including a vane which separates the hydraulic chamber into an advance-side section and a retard-side section, the second rotary body being relatively rotatable with respect to the first rotary body, the second rotary body being accommodated in the first rotary body, and a lock mechanism for locking the second rotary body in an intermediate position between a most advanced position and a most retarded position, the lock mechanism including a through hole formed inside the vane in an axial direction of the second rotary body, a cylindrical member having a cylindrical shape introduced into the through hole in a state in which axial sliding and rotational movement relative to the through hole are restricted, a first lock pin and a second lock pin provided coaxially with each other inside the cylindrical member, a first engagement groove and a second engagement groove which are formed in the first rotary body, and with which the first lock pin and the second lock pin are to be respectively engaged, a biasing member that biases the first lock pin toward the first engagement groove, and that biases the second lock pin toward the second engagement groove, a first lock pin-release oil passage that is formed in an outer circumferential surface of the cylindrical member or in an inner circumferential surface of the through hole, and that is to apply lock pin-release hydraulic pressure to the first engagement groove, and a second lock pin-release oil passage that is formed in the outer circumferential surface of the cylindrical member or in the inner circumferential surface of the through hole, and that is to apply, to the second engagement groove, the lock pin-release hydraulic pressure applied to the first engagement groove, wherein the control device includes:

a processor to execute a program; and a memory to store the program which, when executed by the processor, performs processes of, in a state in which the first lock pin is engaged with the first engagement groove and the second lock pin is engaged with the second engagement groove to lock the second rotary body in the intermediate position, causing the lock pin-release hydraulic pressure to be applied to the first lock pin-release oil passage to disengage the first lock pin from the first engagement groove, thereby making the second rotary body rotatable in an advance direction or in a retard direction, and forming a clearance communicating with the second lock pin-release oil passage, between the first engagement groove and the first lock pin; and causing hydraulic pressure to be applied to the section of the hydraulic chamber corresponding to the direction in which the second rotary body is made rotatable to rotate the second rotary body, and causing the lock pin-release hydraulic pressure in the first engagement groove to be applied through the clearance and through the second lock pin-release oil passage to the second engagement groove to disengage the second lock pin, so that the second rotary body is unlocked.

2. The control device for the valve timing adjustment device according to claim 1, wherein the processes further include:

when the second rotary body is to be locked in the intermediate position, causing lock pin-release hydraulic pressure to be applied to the first engagement groove and to the second engagement groove; causing hydraulic pressure to be applied to one of the advance-side section and the retard-side section of the hydraulic chamber to rotate the second rotary body to a corresponding one of the most advanced position and the most retarded position; and causing the lock pin-release hydraulic pressure to be removed from the first engagement groove and from the second engagement groove, and causing hydraulic pressure to be applied to the other of the advance-side section and the retard-side section of the hydraulic chamber to rotate the second rotary body toward the intermediate position, thereby causing the first lock pin to engage with the first engagement groove and the second lock pin to engage with the second engagement groove, so that the second rotary body is locked.

3. A control method for a valve timing adjustment device that includes a first rotary body including a hydraulic chamber, a second rotary body including a vane which separates the hydraulic chamber into an advance-side section and a retard-side section, the second rotary body being relatively rotatable with respect to the first rotary body, the second rotary body being accommodated in the first rotary body, and a lock mechanism for locking the second rotary body in an intermediate position between a most advanced position and a most retarded position, the lock mechanism including a through hole formed inside the vane in an axial direction of the second rotary body, a cylindrical member having a cylindrical shape introduced into the through hole in a state in which axial sliding and rotational movement relative to the through hole are restricted, a first lock pin and a second lock pin provided coaxially with each other inside the cylindrical member, a first engagement groove and a second engagement groove which are formed in the first rotary body, and with which the first lock pin and the second lock pin are to be respectively engaged, a biasing member that biases the first lock pin toward the first engagement groove, and that biases the second lock pin toward the second engagement groove, a first lock pin-release oil passage that is formed in an outer circumferential surface of the cylindrical member or in an inner circumferential surface of the through hole, and that is to apply lock pin-release hydraulic pressure to the first engagement groove, and a second lock pin-release oil passage that is formed in the outer circumferential surface of the cylindrical member or in the inner circumferential surface of the through hole, and that is to apply, to the second engagement groove, the lock pin-release hydraulic pressure applied to the first engagement groove, the method comprising:

in a state in which the first lock pin is engaged with the first engagement groove and the second lock pin is engaged with the second engagement groove to lock the second rotary body in the intermediate position, causing the lock pin-release hydraulic pressure to be applied to the first lock pin-release oil passage to disengage the first lock pin from the first engagement groove, thereby making the second rotary body rotatable in an advance direction or in a retard direction, and forming a clearance communicating with the second lock pin-release oil passage, between the first engagement groove and the first lock pin; and causing hydraulic pressure to be applied to the section of the hydraulic chamber corresponding to the direction in which the second rotary body is made rotatable to rotate the second rotary body, and causing the lock pin-release hydraulic pressure in the first engagement groove to be applied through the clearance and through the second lock pin-release oil passage to the second engagement groove to disengage the second lock pin, so that the second rotary body is unlocked.

4. The control method for the valve timing adjustment device according to claim 3, the method further comprising:

when the second rotary body is to be locked in the intermediate position, causing lock pin-release hydraulic pressure to be applied to the first engagement groove and to the second engagement groove; causing hydraulic pressure to be applied to one of the advance-side section and the retard-side section of the hydraulic chamber to rotate the second rotary body to a corresponding one of the most advanced position and the most retarded position; and causing the lock pin-release hydraulic pressure to be removed from the first engagement groove and from the second engagement groove, and causing hydraulic pressure to be applied to the other of the advance-side section and the retard-side section of the hydraulic chamber to rotate the second rotary body toward the intermediate position, thereby causing the first lock pin to engage with the first engagement groove and the second lock pin to engage with the second engagement groove, so that the second rotary body is locked.

* * * * *